US010458719B2

(12) United States Patent
Bozorgi et al.

(10) Patent No.: US 10,458,719 B2
(45) Date of Patent: Oct. 29, 2019

(54) HIGH PERFORMANCE TWO-PHASE COOLING APPARATUS

(71) Applicant: PiMEMS, Inc., Santa Barbara, CA (US)

(72) Inventors: Payam Bozorgi, Santa Barbara, CA (US); Carl Meinhart, Santa Barbara, CA (US)

(73) Assignee: PiMEMS, Inc., Santa Barbara, CA (US)

( * ) Notice: Subject to any disclaimer, the term of this patent is extended or adjusted under 35 U.S.C. 154(b) by 127 days.

(21) Appl. No.: 15/000,460

(22) Filed: Jan. 19, 2016

(65) Prior Publication Data

US 2016/0216042 A1 Jul. 28, 2016

Related U.S. Application Data

(60) Provisional application No. 62/106,556, filed on Jan. 22, 2015.

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC .. F28D 15/046; F28D 15/0266; F28D 15/043; H01L 23/427; G06F 1/203; H04M 1/0202
See application file for complete search history.

(56) References Cited

U.S. PATENT DOCUMENTS

| | | | | |
|---|---|---|---|---|
| 3,786,861 | A | 1/1974 | Eggers | |
| 4,800,956 | A | 1/1989 | Hamburgen | |
| 5,179,043 | A * | 1/1993 | Weichold | F28D 15/0233 165/104.26 |
| 5,520,244 | A | 5/1996 | Mundiger et al. | |
| 7,718,552 | B2 | 5/2010 | Samah et al. | |
| 8,807,203 | B2 | 8/2014 | MacDonald et al. | |
| 2001/0003308 | A1 * | 6/2001 | Li | F28D 9/0062 165/104.33 |
| 2002/0144600 | A1 * | 10/2002 | TeGrotenhuis | B01B 1/005 95/273 |

(Continued)

FOREIGN PATENT DOCUMENTS

| | | |
|---|---|---|
| WO | WO 2007/019558 | 2/2007 |
| WO | WO/2012/106326 A1 | 9/2012 |

*Primary Examiner* — Keith M Raymond
*Assistant Examiner* — Gordon A Jones
(74) *Attorney, Agent, or Firm* — Jaquelin K. Spong

(57) ABSTRACT

The present application discloses two-phase cooling devices that may include at least three substrates: a metal with a wicking structure, an intermediate substrate and a back-plane. A fluid may be contained within the wicking structure and vapor cavity for transporting thermal energy from one region of the thermal ground plane to another region of the thermal ground plane, wherein the fluid may be driven by capillary forces within the wicking structure. The intermediate substrate may form narrow channels within the wicking structure, providing high capillary forces to support large pressure differences between the liquid and vapor phases, while minimizing viscous losses of the liquid flowing in the wicking structure.

18 Claims, 21 Drawing Sheets

(56) References Cited

U.S. PATENT DOCUMENTS

2007/0084587 A1* 4/2007 Huang ..... B22F 5/106
165/104.26
2009/0159242 A1* 6/2009 Zhao ..... B22F 3/11
165/104.26
2010/0044014 A1* 2/2010 Ho ..... F28D 1/035
165/104.26
2010/0157533 A1 6/2010 Oniki
2010/0175856 A1* 7/2010 Meyer, IV ..... B22F 7/004
165/104.26
2011/0088875 A1* 4/2011 Hou ..... F28D 15/0266
165/104.26
2011/0174474 A1* 7/2011 Liu ..... C23C 28/30
165/185
2013/0327504 A1 12/2013 Bozorgi et al.
2014/0060780 A1* 3/2014 Moon ..... H05K 7/20336
165/104.21
2014/0126167 A1 5/2014 Bozorgi et al.
2014/0318167 A1* 10/2014 Uchida ..... H01L 23/427
62/259.2
2015/0226493 A1* 8/2015 Yang ..... F28D 15/046
165/104.26
2017/0030654 A1* 2/2017 Yang ..... F28D 15/046

* cited by examiner (A)

(C)

Adiabatic Region

Condenser Region

HIGH PERFORMANCE TWO-PHASE COOLING APPARATUS

CROSS REFERENCE TO RELATED APPLICATIONS

This application claims priority to U.S. Provisional application Ser. No. 62/106,556 filed Jan. 22, 2015 and incorporated by reference in its entirety.

STATEMENT REGARDING FEDERALLY SPONSORED RESEARCH

Not applicable.

STATEMENT REGARDING MICROFICHE APPENDIX

Not applicable.

BACKGROUND

This invention relates to cooling of semiconductor devices, and, more particularly, to cooling systems to cool semiconductor and other devices.

Electronics employing various semiconductor devices and integrated circuits are commonly subjected to various environmental stresses. Applications of such electronics are extremely widespread, and utilize different semiconductor materials.

Many electronic environments, such as mobile devices or laptop computers have thin/planar configurations, where many components are efficiently packed into a very confined space. As a result, cooling solutions must also conform to thin/planar configurations. Heat spreaders in the form of thin thermal ground planes (TGPs) may be desirable for many electronic cooling applications.

SUMMARY

The present application discloses two-phase cooling devices. Two-phase cooling devices are a class of devices that can transfer heat with very high efficiency, and may include: heat pipes, thermal ground planes, vapor chambers and thermosiphons, and the like.

In some embodiments, the present application provides two-phase cooling devices including at least three substrates. In some embodiments, one or more of the substrates is formed from microfabricated metal, such as but not limited to titanium, aluminum, copper, or stainless steel. In some embodiments the substrate may be formed as a thermal ground plane structure suitable for use in electronic devices. In some embodiments, the two-phase device may comprise a predetermined amount of at least one suitable working fluid, where the working fluid adsorbs or rejects heat by changing phases between liquid and vapor.

In some embodiments, the present application may provide two-phase cooling devices including a metal, such as but not limited to titanium, aluminum, copper, or stainless steel, substrate comprising a plurality of etched microstructures, forming a wicking structure wherein one or more of the microstructures have a height of between about 1-1000 micrometers, a width of between about 1-1000 micrometers, and a spacing of between about 1-1000 micrometers. In some embodiments a vapor cavity may be in communication with the plurality of metal microstructures. In some embodiments at least one intermediate substrate may be in communication with the wicking structure and the vapor region. In some embodiments, a fluid may be contained within the wicking structure and vapor cavity for transporting thermal energy from one region of the thermal ground plane to another region of the thermal ground plane, wherein the fluid may be driven by capillary forces within the wicking structure.

In some embodiments the cooling device can be configured for high capillary force in the wicking structure, to support large pressure differences between the liquid and vapor phases, while minimizing viscous losses of the liquid flowing in the wicking structure. In some embodiments, the cooling device may be a thermal ground plane which can be made very thin, and could possibly transfer more thermal energy than can be achieved by earlier TGP's. In some embodiments, different structural components could be located in an evaporator region, an adiabatic region and a condenser region. In some embodiments, an evaporator region may contain an intermediate substrate that comprises a plurality of microstructures that when mated with the wicking structure form high aspect ratio structures. In some embodiments, the intermediate substrate features are interleaved with the wicking structure features to increase the effective aspect ratio of the wicking structure. In some embodiments, an adiabatic region may contain an intermediate substrate positioned in close proximity to the wicking structure to separate the vapor in the vapor chamber from the liquid in the wicking structure. In some embodiments, a condenser region may contain an intermediate substrate that has large openings (compared to the microstructure) so that the wicking structure is in direct communication with the vapor chamber. In some embodiments, a condenser region might not contain an intermediate substrate so that the wicking structure is in direct communication with the vapor chamber.

BRIEF DESCRIPTION OF THE DRAWINGS

Various exemplary details are described with reference to the following figures, wherein.

It should be understood that the drawings are not necessarily to scale, and that like numbers may refer to like features.

DETAILED DESCRIPTION

Figure 1:
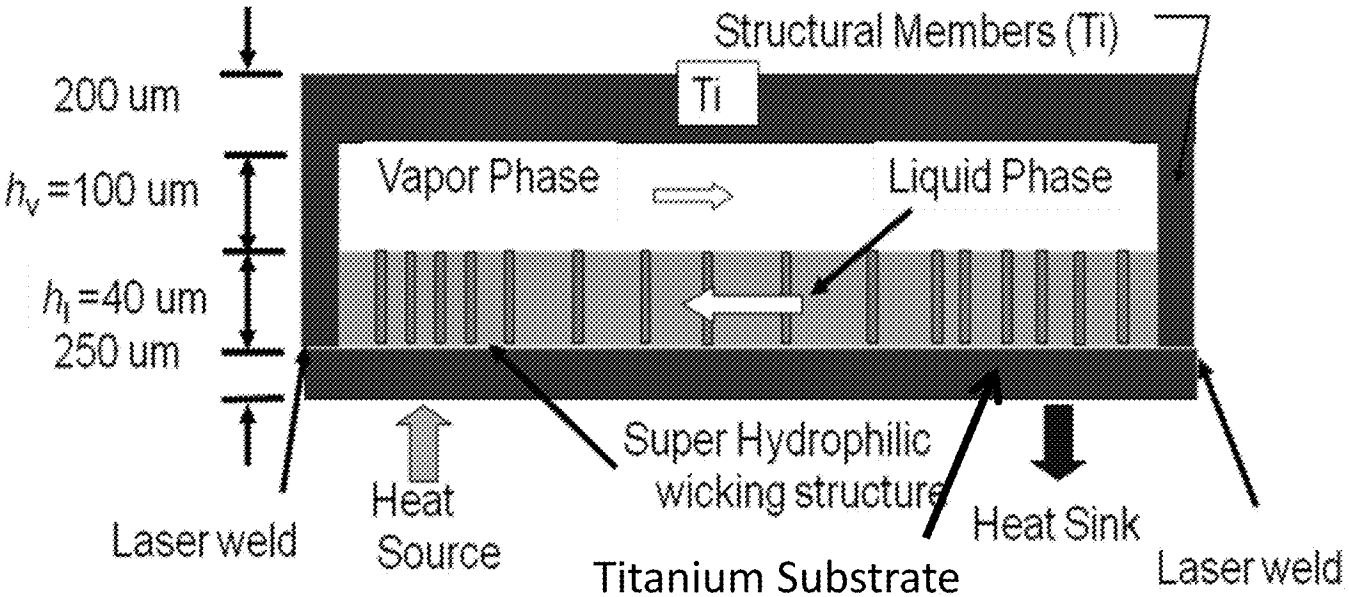
FIG. 1 is an illustrative embodiment of an earlier titanium-based thermal ground plane, comprising a titanium substrate with a wicking structure, a backplane, and a vapor chamber.

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

In some embodiments, the thermal ground planes disclosed here could be used to provide efficient space utilization for cooling semiconductor devices in a large range of applications, including but not limited to aircraft, satellites, laptop computers, desktop computers, mobile devices, automobiles, motor vehicles, heating air conditioning and ventilation systems, and data centers.

Microfabricated substrates can be used to make more robust, shock resistant two-phase cooling devices, which may be in the form of Thermal Ground Planes (TGPs). Although a variety of materials for these substrates may be employed, as described in the incorporated references, metal, such as but not limited to titanium, aluminum, copper, or stainless steel substrates have been found suitable for TGPs.

The choice of metal can depend upon the various applications and cost considerations. There are advantages to various metals. For example, copper offers the highest thermal conductivity of all the metals. Aluminum can be advantageous for applications where high thermal conductivity is important and weight might be important. Stainless steel could have advantageous in certain harsh environments.

Titanium has many advantages. For example, titanium has a high fracture toughness, can be microfabricated and micromachined, can resist high temperatures, can resist harsh environments, can be bio-compatible. In addition, titanium-based thermal ground planes can be made light weight, relatively thin, and have high heat transfer performance. Titanium can be pulse laser welded. Since titanium has a high fracture toughness, it can be formed into thin substrates that resist crack and defect propagation. Titanium has a relatively low coefficient of thermal expansion of approximately $8.6\times10^{-6}$/K. The low coefficient of thermal expansion, coupled with thin substrates can help to substantially reduce stresses due to thermal mismatch. Titanium can be oxidized to form Nano Structured Titania (NST), which forms stable and super hydrophilic surfaces. In some embodiments, titanium (Ti) substrates with integrated Nano Structured Titania (NST) have been found suitable for TGP's.

Metals, such as but not limited to titanium, aluminum, copper, or stainless steel, can be microfabricated with controlled characteristic dimensions (depth, width, and spacing) ranging from about 1-1000 micrometers, to engineer the wicking structure and intermediate substrate for optimal performance and customized for specific applications. In some embodiments, the controlled characteristic dimensions (depth, width, and spacing) could range from 10-500 micrometers, to engineer the wicking structure for optimal performance and customized for specific applications.

In some embodiments, titanium can be oxidized to form nanostructured titania (NST), which could provide super hydrophilic surfaces and thereby increase capillary forces, and enhance heat transfer. In some embodiments, the NST can be comprised of hair-like patterns with a nominal roughness of 200 nanometers (nm). In some embodiments, NST can have a nominal roughness of 1-1000 nm.

In some embodiments aluminum can be oxidized to form hydrophilic nanostructures, to provide super hydrophilic coatings. In some embodiments, sintered nanoparticles and/or microparticles could be used to provide super hydrophilic surfaces and thereby increase capillary forces, and enhance heat transfer.

In some embodiments, titanium can be coated on another type of substrate forming a titanium film. The titanium film can be oxidized to form nano-structured titania (NST), and thereby provide super hydrophilic surfaces.

Titanium is a material that can be microfabricated using cleanroom processing techniques, macro-machined in a machine shop, and hermetically packaged using a pulsed laser micro welding technique. When the thermal ground plane is comprised of only titanium or titania as the structural material, the various components can be laser welded in place, without introducing contaminants, which could possibly produce non-condensable gasses, contribute to poor performance, and possibly lead to failure. In addition, titanium and titania have been shown to be compatible with water, which can contribute to long lifetimes and minimal non-condensable gas generation. Accordingly, the titanium substrate may be connected to the titanium backplane by a laser weld, to form a hermetically-sealed vapor cavity.

Metals can be bonded to form hermetic seals. In some embodiments, titanium substrates can be pulsed laser micro-welded together to form a hermetic seal. In other embodiments, copper, aluminum, and stainless steel substrates could be welded using a variety of techniques, such as but not limited to, soldering, brazing, vacuum brazing, TIG, MIG, and many other well-known welding techniques.

The present application describes the fabrication of metal-based Thermal Ground Planes (TGPs). Without loss of generality, the present application discloses thermal ground plane embodiments that could be comprised of three or more metal substrates.

An embodiment can comprise three substrates (of which one or more can be constructed using a metal, such as but not limited to titanium, aluminum, copper, or stainless steel) to form a thermal ground plane. In some embodiments, titanium substrates could be used to form a thermal ground plane. In some embodiments, one substrate supports an integrated super-hydrophilic wicking structure 220, a second substrate consists of a deep-etched (or macro-machined) vapor cavity, and a third intermediate substrate 110 may consist of microstructures 112 and are in communication with the wicking structure 220 and the vapor chamber 300. The substrates could be laser micro welded together to form the thermal ground plane.

The working fluid can be chosen based upon desired performance characteristics, operating temperature, material compatibility, or other desirable features. In some embodiments, and without loss of generality, water could be used as the working fluid. In some embodiments, and without loss of generality, helium, nitrogen, ammonia, high-temperature organics, mercury, acetone, methanol, Flutec PP2, ethanol, heptane, Flutec PP9, pentane, caesium, potassium, sodium, lithium, or other materials, could be used as the working fluid.

The current TGP can provide significant improvement over earlier titanium-based thermal ground planes. For example, the present invention could provide significantly higher heat transfer, thinner thermal ground planes, thermal ground planes that are less susceptible to the effects of gravity, and many other advantages.

The following co-pending and commonly-assigned U.S. patent applications are related to the instant application, and are incorporated by reference in their entirety: U.S. Pat. No. 7,718,552 B2, issued May 18, 2010, by Samah, et al, entitled "NANOSTRUCTURED TITANIA," which application is incorporated by reference herein. U.S. Patent Application Ser. No. 61/082,437, filed on Jul. 21, 2008, by Noel C. MacDonald et al., entitled "TITANIUM-BASED THERMAL GROUND PLANE," which application is incorporated by reference herein. U.S. patent application Ser. No. 13/685,579, filed on Nov. 26, 2012, by Payam Bozorgi et al., entitled "TITANIUM-BASED THERMAL GROUND PLANE," which application is incorporated by reference herein. PCT Application No. PCT/US2012/023303, filed on Jan. 31, 2012, by Payam Bozorgi and Noel C. MacDonald, entitled "USING MILLISECOND PULSED LASER WELDING IN MEMS PACKAGING," which application is incorporated by reference herein. U.S. Patent Provisional Application Ser. No. 62/017455, filed on Jun. 26, 2014, by Payam Bozorgi and Carl Meinhart, entitled "TWO-PHASE COOLING DEVICES WITH LOW-PROFILE CHARGING PORTS," which application is incorporated by reference herein.

FIG. 1 illustrates a thermal ground plane, which in some embodiments may be a titanium-based thermal ground plane, comprising a titanium substrate with a wicking structure, a backplane, and a vapor chamber described in the incorporated references. The device may be pulsed micro-welded to form a hermetic seal. The thermal ground plane can be charged with a working fluid, such as water in a thermodynamically saturated state, where the liquid phase resides predominantly in the wicking structure, and the vapor phase resides predominantly in the vapor chamber.

Figure 2:
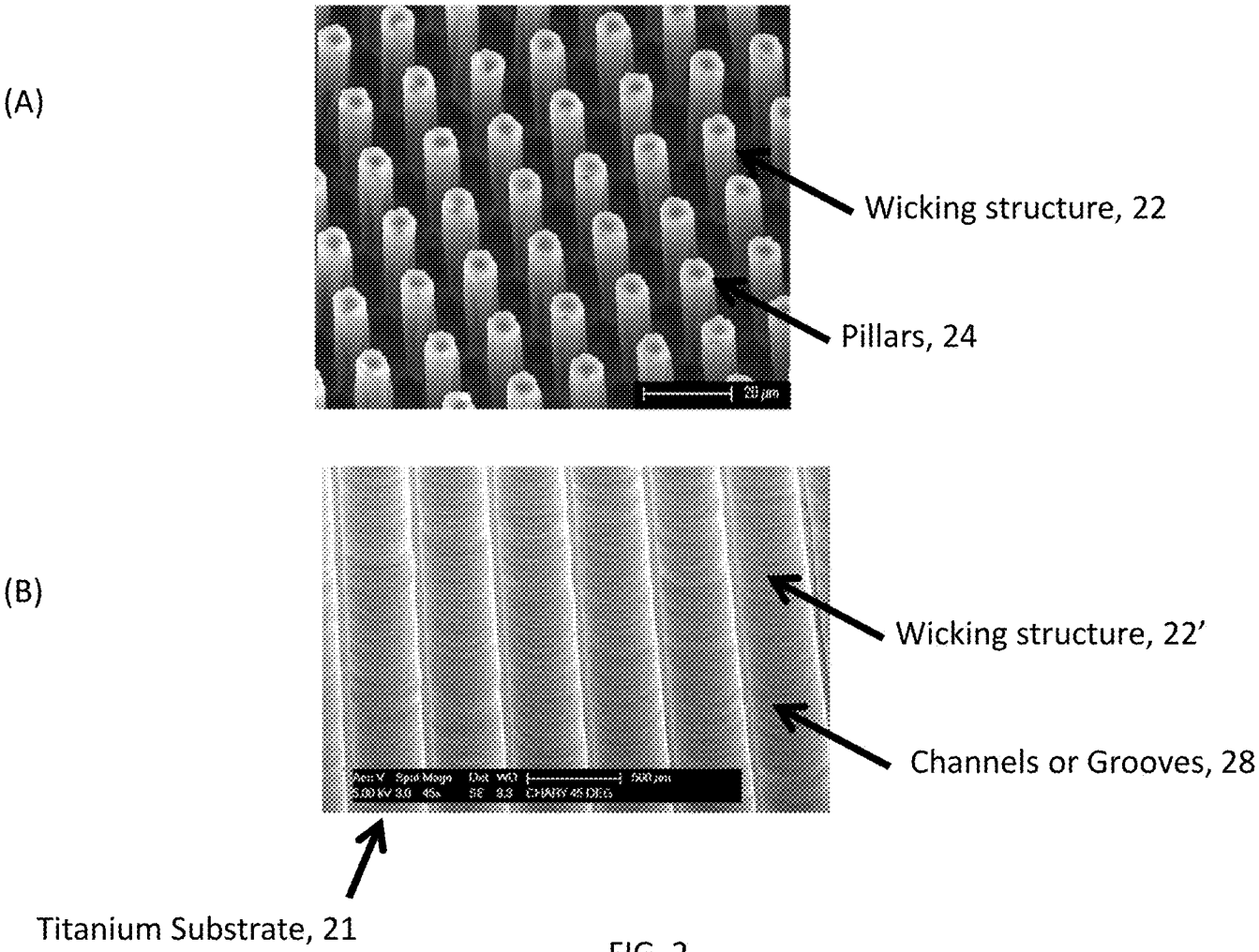
FIG. 2 is an illustrative embodiment of earlier titanium substrates with a wicking structure: (A) the wicking structure comprises pillars, (B) the wicking structure comprises channels or grooves.

As described in the incorporated references, the wicking structure can be formed from a plurality of pillars, channels, grooves, trenches, or other geometric structures. For example, FIG. 2(A) illustrates an earlier TGP where a titanium wicking structure 22 is comprised of pillars 24. FIG. 2(B) illustrates an earlier TGP where a titanium wicking structure 22' is comprised of channels or grooves 28 on a titanium substrate 21.

Figure 3:
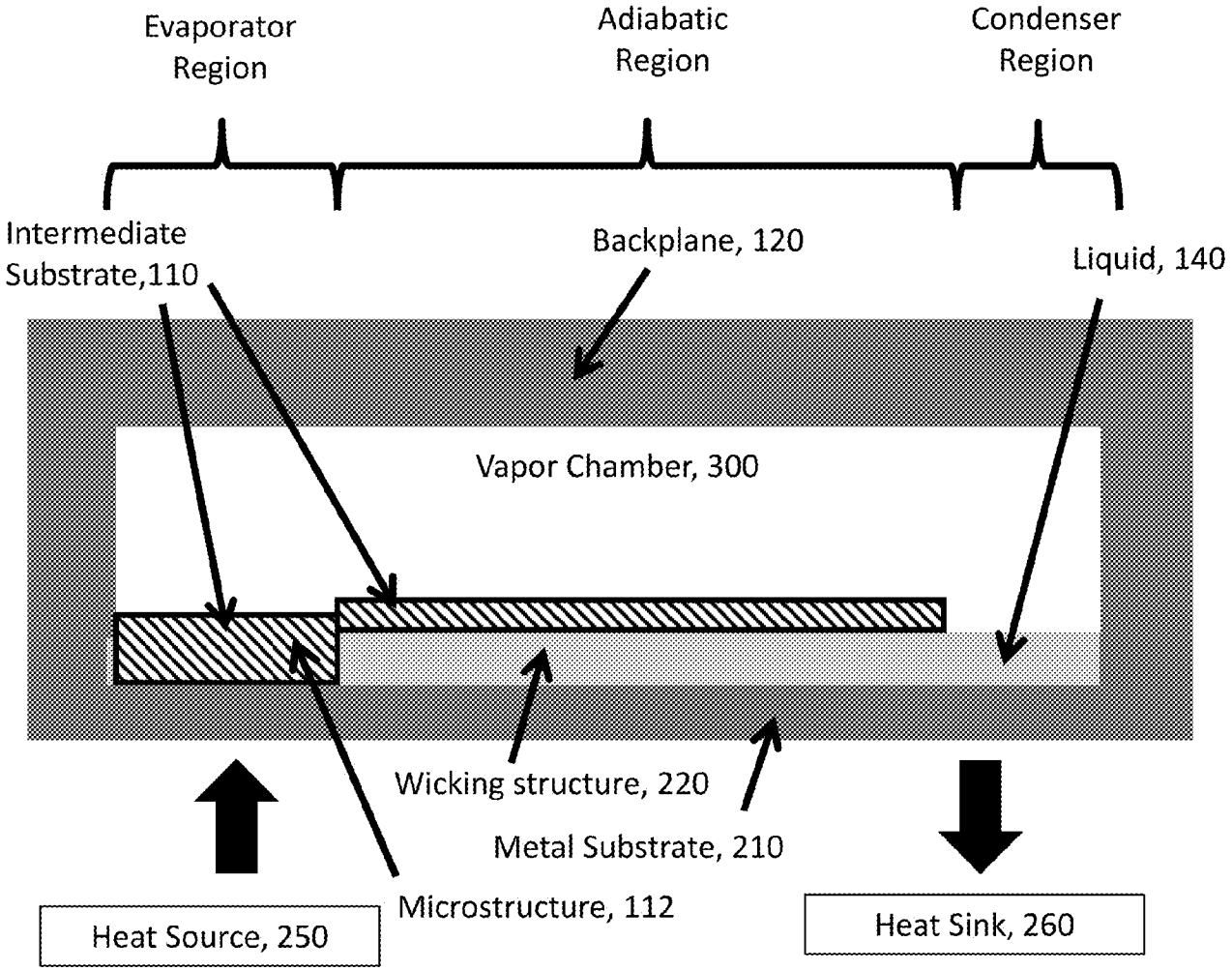
FIG. 3 is an illustrative embodiment of a metal-based thermal ground plane with an intermediate substrate in communication with a wicking structure and a vapor chamber. The intermediate layer could comprise microstructures. (A) shows a profile view depicting components of an embodiment, (B) shows an exploded view of structural components of an embodiment.
Figure 3:
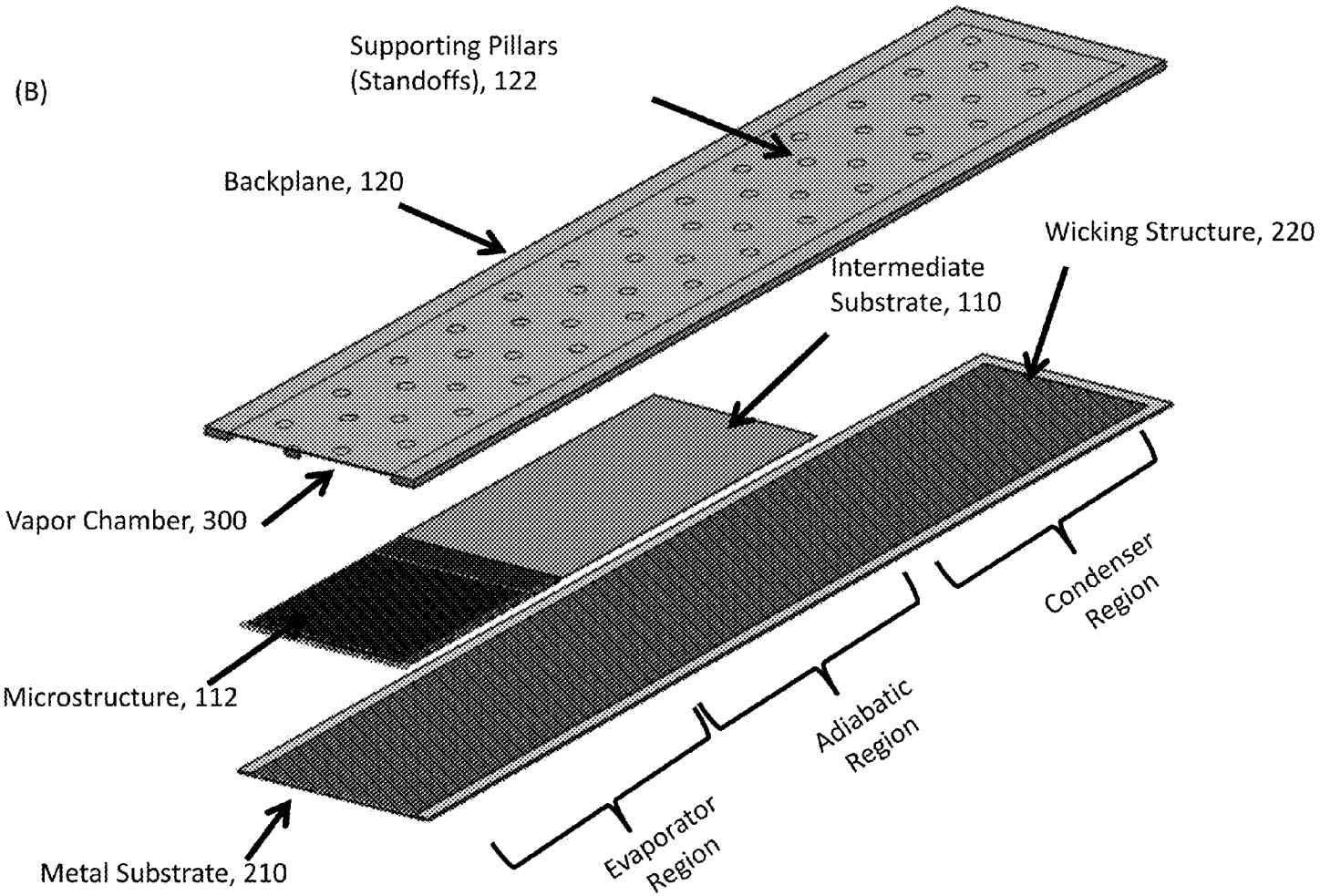

FIG. 3 illustrates an embodiment of a novel metal-based thermal ground plane with an intermediate substrate 110 in communication with a wicking structure 220 and a vapor chamber 300. The intermediate layer could comprise microstructures 112. FIG. 3(A) shows a profile view depicting components of an embodiment, while FIG. 3(B) shows an exploded view of structural components of an embodiment. The metal substrate 210 could be bonded to a metal backplane 120 to form a hermetically-sealed vapor cavity 300. The vapor cavity 300 may therefore be enclosed by the metal substrate 210 and the metal backplane 120. For example, in an embodiment, a titanium substrate could be pulsed laser micro-welded to a titanium backplane 120 to form a hermetically sealed vapor cavity.

In some embodiments, a plurality of intermediate substrates 110 could be used, where at least one different intermediate substrate 110 could be used for each different region of the thermal ground plane. The plurality of intermediate substrates 110 could be positioned in close proximity to each other to collectively provide overall benefit to the functionality of the thermal ground plane.

In some embodiments, the intermediate substrate 110 could contain regions that are comprised of a plurality of microstructures 112, with characteristic dimensions (depth, width, and spacing) ranging from 1-1000 micrometers. In some embodiments, the intermediate substrate 110 could contain regions that are comprised of a plurality of microstructures 112, with dimensions (depth, width, and spacing) ranging from 10-500 micrometers.

The at least one intermediate substrate 110 may contain regions that are comprised of a plurality of microstructures 112, regions that are comprised of solid substrates, and regions that are comprised of at least one opening in the at least one intermediate substrate 110 (that is large compared to the microstructures 112, and for example openings could range in dimension of 1 millimeter-100 millimeters, or 1 millimeter-1000 millimeters.

In some embodiments, the opening in the intermediate substrate 110 for chosen regions of the thermal ground plane could be achieved by simply not providing an intermediate substrate 110 in those regions. Thermal energy can be supplied by a heat source 250 and removed by a heat sink 260. Thermal energy can be transferred from one region (evaporator region) of the metal substrate 210 to another region (condenser region) of the metal substrate 210. In the evaporator region, the local temperature is higher than the saturation temperature of the liquid/vapor mixture, causing the liquid 140 to evaporate into vapor, thereby absorbing thermal energy due to the latent heat of vaporization.

The vapor residing in the vapor chamber 300 can flow from the evaporator region through the adiabatic region to the condenser region. The heat sink 260 could absorb heat from the condenser region causing the local temperature to be lower than the saturation temperature of the liquid/vapor mixture, causing the vapor to condense into the liquid phase, and thereby releasing thermal energy due to the latent heat of vaporization.

The condensed liquid 140 could predominantly reside in the wicking structure 220 and could flow from the condenser region through the adiabatic region to the evaporator region as a result of capillary forces.

As a result it could be advantageous for high-performance heat pipes to: (1) exhibit minimal viscous losses for the liquid 140 flowing through the wicking structure 220, and to (2) exhibit maximal capillary forces in the evaporator region. In many practical thermal ground plane embodiments, minimal viscous losses and maximal capillary forces are difficult to achieve simultaneously. Introducing an intermediate substrate 110 with a plurality of microstructures 112, configured as appropriate in each of the three regions could provide a means in which the thermal ground plane could have reduced viscous losses in some regions, while exhibiting increased capillary forces in other regions, compared to earlier TGP's with more or less the same structure over a majority of the interior.

In some embodiments, supporting pillars (standoffs) are used to mechanically support the spacing between the backplane 120 and the wicking structure 220 and/or intermediate substrate 110. In some embodiments, the supporting pillars (standoffs) provide controlled spacing for the vapor chamber 300. The supporting pillars (standoffs) could be microfabricated using chemical wet etching techniques or other fabrication techniques (as described above). Accordingly, the backplane may include standoffs that are in communication with the intermediate substrate and/or the metal substrate, for structurally supporting the thermal ground plane.

Figure 4:
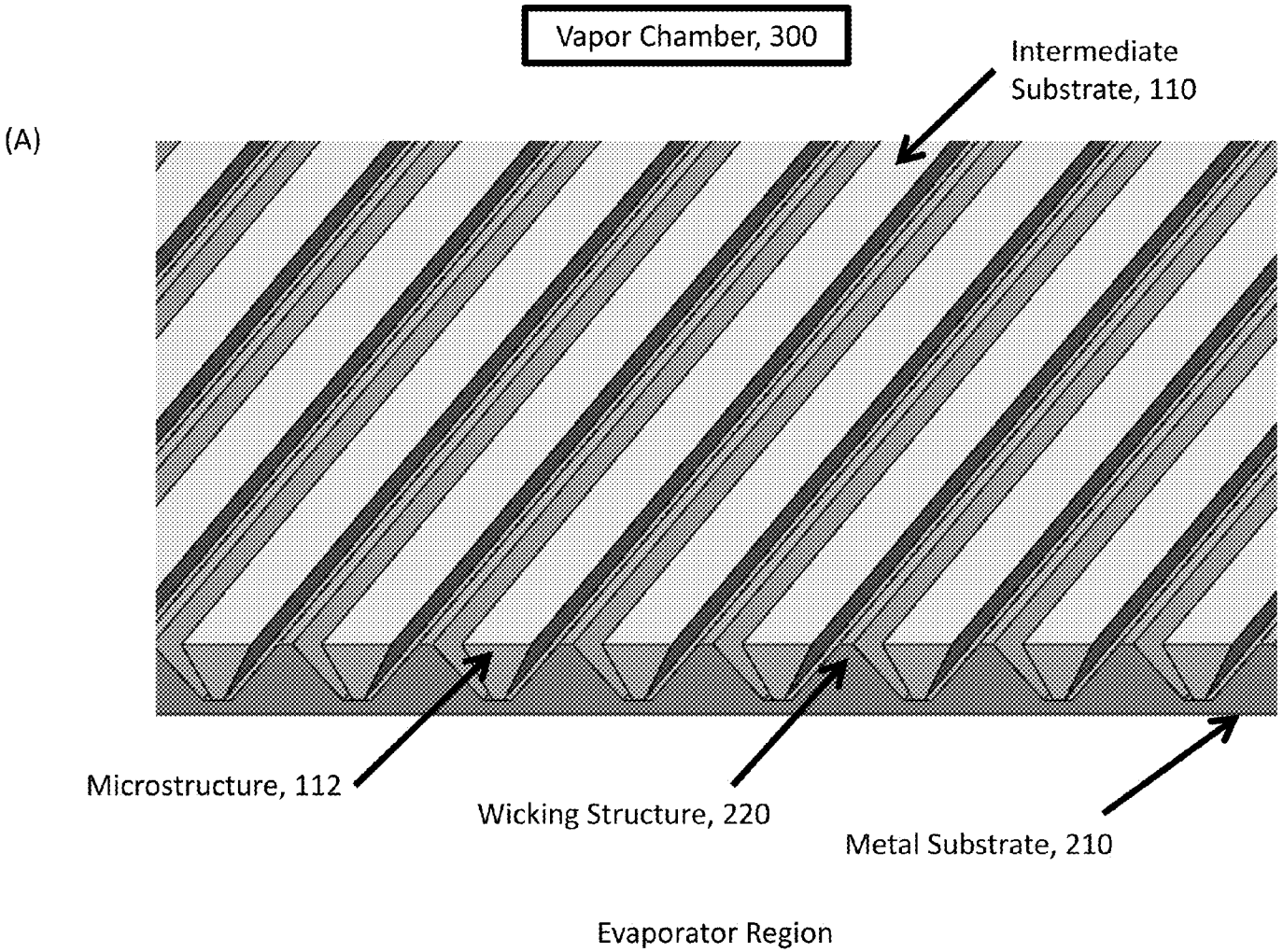
FIG. 4 depicts structural components according to an illustrative embodiment where the different structural components are located in an evaporator region, an adiabatic region and a condenser region: (A) shows an evaporator region of an embodiment where the intermediate substrate comprises a plurality of microstructures that are interleaved with the wicking structure, (B) shows an adiabatic region of an embodiment where the intermediate substrate is positioned in close proximity to the wicking, (C) shows a condenser region of an embodiment where the wicking structure is in direct communication with the vapor chamber, and (D) shows detail of an embodiment of an intermediate substrate.
Figure 4:
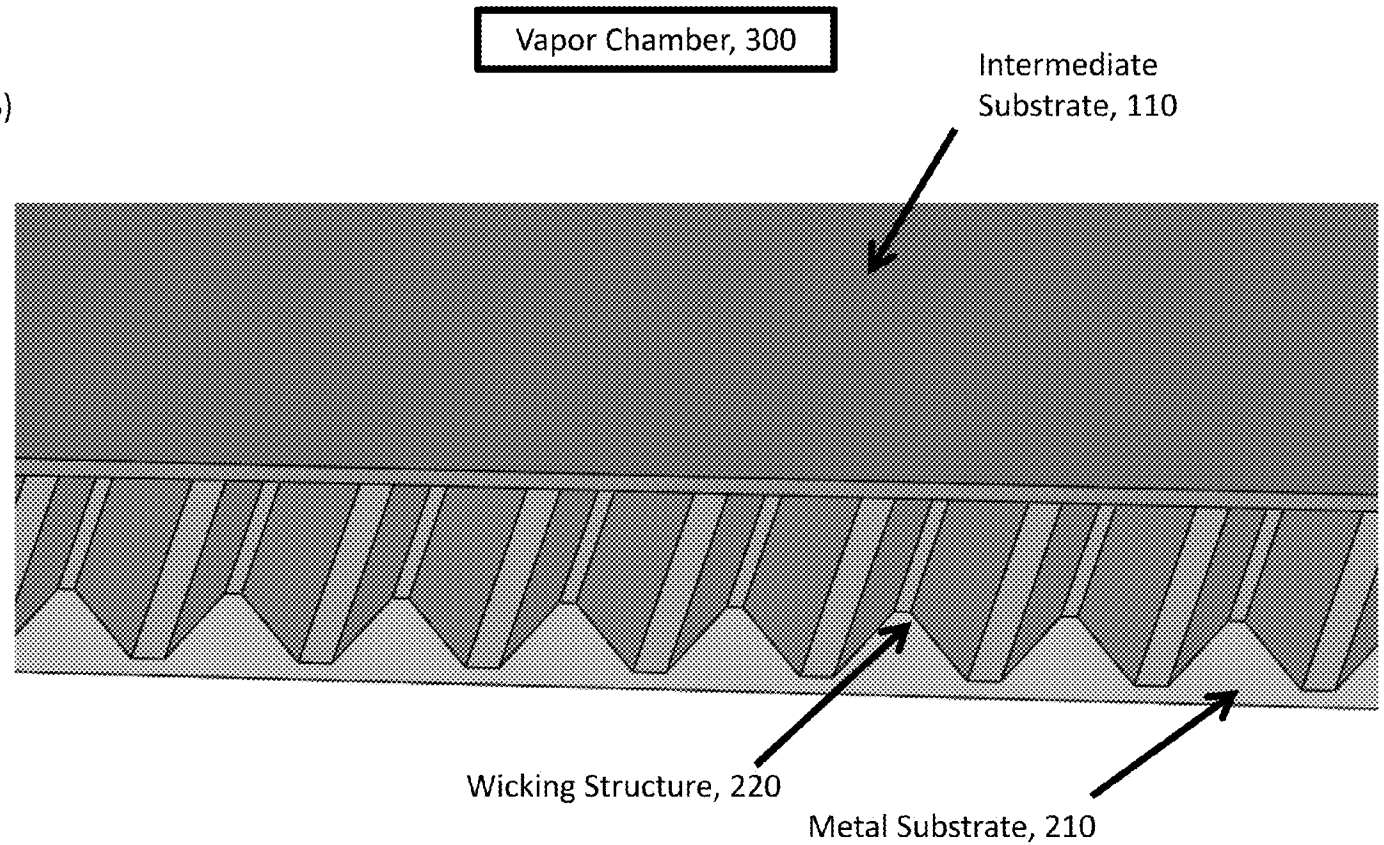
Figure 4:
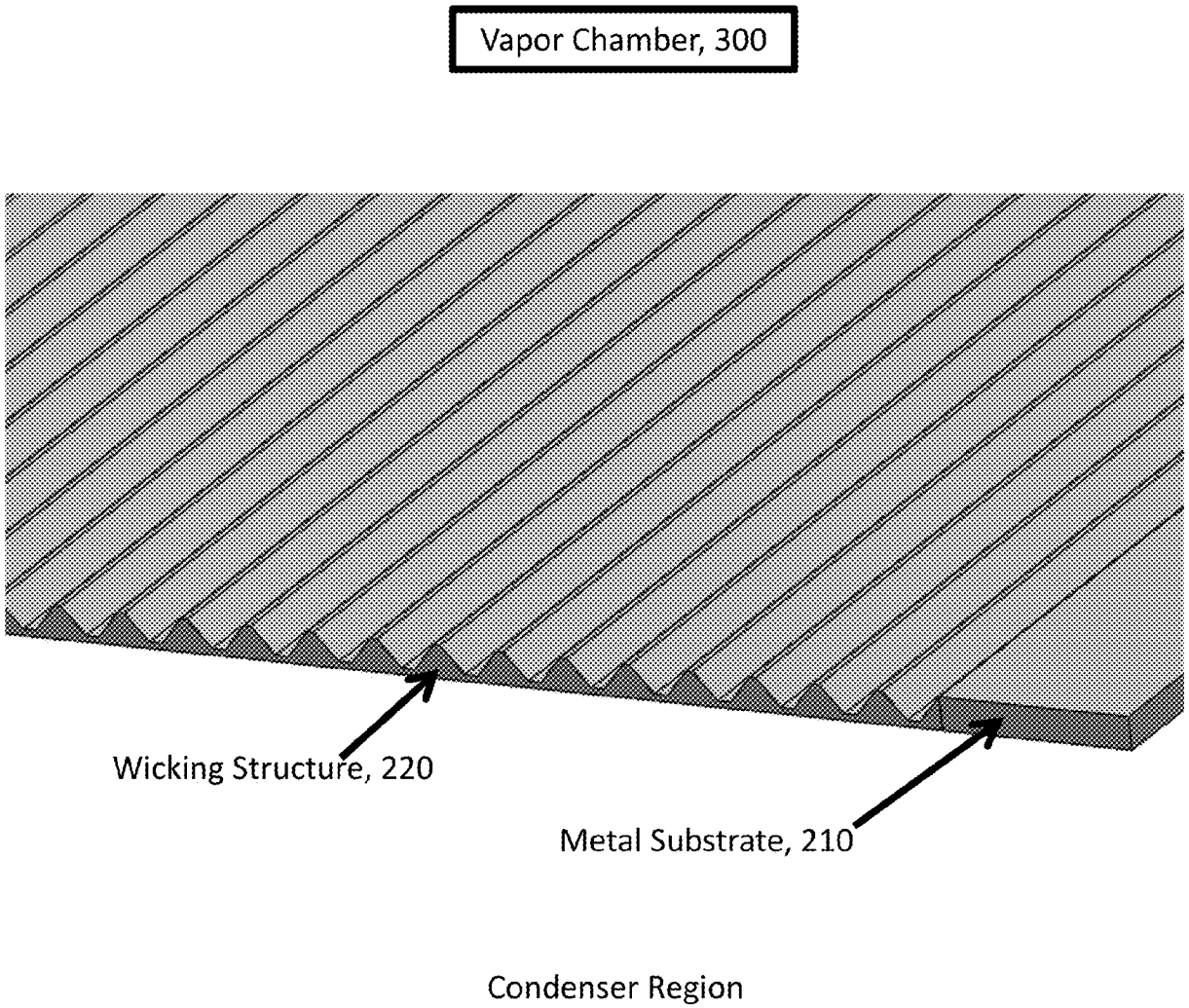
Figure 4:
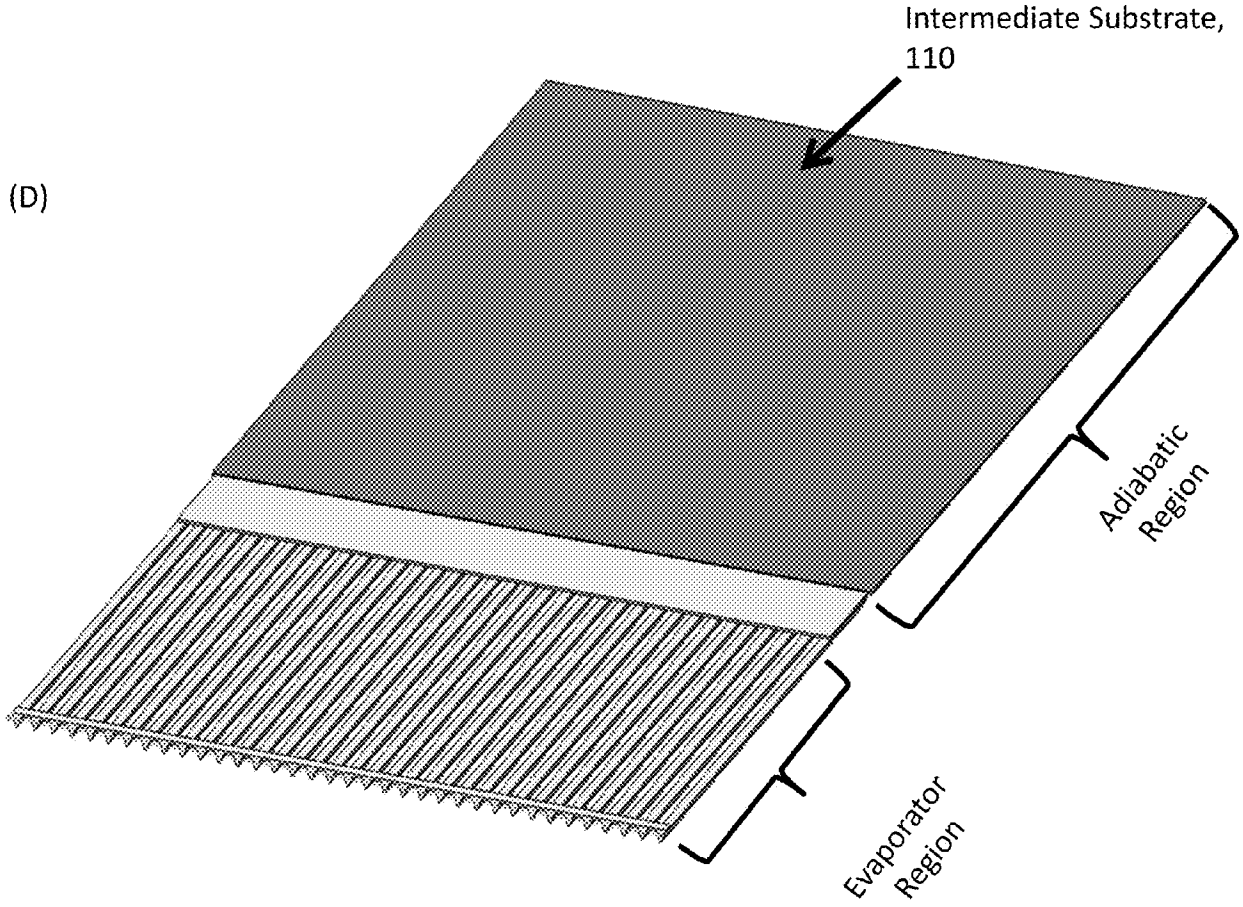

FIG. 4 depicts structural components of an embodiment where the different structural components are located in an evaporator region, an adiabatic region and a condenser region: (A) shows an evaporator region of an embodiment where the intermediate substrate 110 comprises a plurality of microstructures 112 that are positioned to increase the effective aspect ratio of the wicking structure 220. The fingers (microstructures 112) from the intermediate substrate 110 are interleaved with channels in the wicking structure 220, thereby creating double the number of higher aspect ratio features, compared to the lower aspect ratio features of the wicking structure 220 without the intermediate substrate 110. FIG. 4(B) shows an adiabatic region of an embodiment where the intermediate substrate 110 is positioned in close proximity to the wicking structure 220, and (C) shows a condenser region of an embodiment, where the wicking structure 220 is in direct communication with the vapor chamber 300. (D) shows the intermediate substrate 110 as a whole.

Accordingly, the thermal ground plane may have an evaporator region, an adiabatic region, and a condenser region. The intermediate substrate, in turn, may have a different topography in the different regions, and in particular in the evaporator region relative to an adiabatic region.

FIG. 4(A) depicts an embodiment where the intermediate substrate 110 comprises a plurality of microstructures 112 that are interleaved with the wicking structure 220 of the metal substrate 210. By interleaving the microstructures 112 of the intermediate region with the wicking structure 220 of the metal substrate 210, the interface between the solid and liquid can be substantially increased. This could increase the capillary forces that are applied to the liquid, and could increase the amount of heat transferred from the metal solid to the liquid.

FIG. 4(B) shows an adiabatic region of an embodiment where the intermediate substrate 110 is positioned in close proximity to the wicking structure 220. A solid intermediate substrate 110 could be used to isolate the vapor chamber 300 from the wicking structure 220. By isolating the vapor chamber 300 from the wicking structure 220, the solid-liquid interface area could be increased, and the liquid could fill substantially the wicking structure 220, without a meniscus occupying the channel, and which could provide a higher mass flow rate for the liquid with less viscous pressure drop, compared to the earlier TGP's where the liquid in the wicking structure 220 could be exposed directly to the vapor in the vapor chamber 300 with a meniscus residing at the liquid/vapor interface.

FIG. 4(C) shows a condenser region of an embodiment where the wicking structure 220 is in direct communication with the vapor chamber 300. When the wicking structure 220 is in direct communication with the vapor chamber 300, vapor could more easily condense onto the wicking structure 220. Furthermore, in regions, such as the condenser, there might not be significant differences in pressure between the liquid and vapor phases, and an intermediate substrate 110 may not provide significant advantages.

However, in other embodiments, if the condenser region was relatively large and there was significant pressure difference between the liquid and vapor phases, an intermediate substrate 110 could provide advantages in the condenser region as well.

FIG. 4 (D) shows an illustrative embodiment of an implementation of an intermediate substrate 110 as described above. The evaporator region of the intermediate substrate 110 includes rows of wedge shaped fingers supported across each end, such that when the TGP is assembled, the fingers interleave with the substrate wicking microstructures 112 as shown in FIG. 4(A), where the interleaved structures are exposed to the vapor chamber 300. The adiabatic region of the intermediate substrate 110 is a cover that overlays a portion of the wicking microstructures 112, as shown in FIG. 4(B). The condenser region may not require an intermediate substrate 110 component in some embodiments, as shown in FIG. 4(C).

The aspect ratio is commonly defined as the ratio of one major dimension of a structure to another major dimension of a structure. For pillars, channels, trenches, grooves or other features used in heat pipe applications, the effective aspect ratio may refer to the ratio between the height and the width of the region occupied by a fluid, such as a liquid 140 flowing through a wicking structure 220. In some embodiments, the intermediate substrate 110 may include one section (as shown by example in FIG. 4(A)) that in combination with the wicking structure 220 provides an effective aspect ratio that is substantially higher than the aspect ratio provided only by the wicking structure 220. In other words, the intermediate substrate 110 may have a region with a plurality of protrusions that fit conformally into the wicking structure 220, to form narrow fluid passages through which the fluid is driven by capillary forces. The protrusion may be shaped to fit into features in the wicking structure 220, as shown in FIG. 4(A).

For some desirable micromachining processes, such as wet chemical etching, it may be difficult to achieve a high aspect ratio in the wicking structure 220. Interleaving two structures may achieve a higher aspect ratio in the wicking structure, than could otherwise be achieved using a single wet-etched structure. The intermediate substrate 110 may include another section (as shown by example in FIG. 4(B) that is basically a cap on the wicking structure 220 to minimize viscous losses, isolate the liquid from the vapor that is in close proximity above, and improve flow volume. A third section (as shown by example in FIG. 4(C)), where the intermediate substrate 110 is comprised of openings, that are more open than said microstructures 112, to facilitate direct communication between the wicking structure 220 and the vapor region, and promote condensation. Accordingly, the openings of the intermediate substrate may be substantially more open than said microstructures, so the wicking structure and vapor chamber could be in direct communication, in at least one region of the thermal ground plane.

Thus, the addition of the intermediate substrate 110 allows for optimization of the wicking structure 220 in each of the three operational regions of the cooling device, and in a way that could be compatible with micromachining processes, such as wet etching techniques, and assembly techniques.

Without loss of generality, the wicking structure 220 could be formed by dry etching, wet chemical etching, other forms of micromachining, macromachining, sawing with a dicing saw, and many other types of processes. In some embodiments, dry etching could provide high aspect ratio channels, where the depth is comparable or perhaps even larger than the width of the channels. However, dry etching may be limited to smaller regions and may not be desirable for large-scale manufacturing, compared to wet etching processes. Mask-based wet etching could be desirable as it could be applicable to relatively large etch regions, could be cost effective, and could be compatible with high-volume manufacturing. In some embodiments, photolithography-based methods could be used to dry or wet etching.

In some embodiments the wicking structure 220 could be formed by standard wet chemical etching techniques. In some embodiments, wet chemical etching can limit the aspect ratio, which is the ratio of the wicking channel depth to the wicking channel width. In some embodiments that use wet etching, the wicking channel width can be at least 2 to 2.5 times wider than the wicking channel etch depth. In some embodiments, where the wicking channel width is at least 2 to 2.5 times wider than the wicking channel etch depth, there could be significant disadvantages to low aspect ratio wicking channels.

The pressure between the vapor and liquid phases can be described by the Laplace pressure, $\Delta P = P_v - P_l = 2\gamma/R$, where $P_v$ is the vapor pressure, $P_l$ is the liquid pressure, $\gamma$ is the surface tension, and R is the radius of curvature of the surface. A high pressure difference between the liquid and vapor phases could be obtained by decreasing the radius of curvature, R.

Generally, a smaller radius of curvature can be achieved by having material surfaces that exhibit low contact angles, and by forming geometries with relatively small geometric dimensions. In many embodiments, it may be desirable to have low viscous losses for the liquid flowing through the wicking structure 220. Small geometric dimensions in the wicking structure 220 can significantly increase the viscous losses of liquid flowing through the wicking structure 220. Therefore, in some embodiments, it may be difficult to achieve low viscous losses, and have a meniscus with a small radius of curvature that can support a high pressure difference between the vapor and liquid phases. The current application discloses a means in which some embodiments can be configured for maximum capillary forces, support large pressure differences between the liquid and vapor phases, for example in the evaporator region. The current application discloses a means in which some embodiments can be configured to minimize viscous losses of the liquid flowing in the wicking structure 220, by using different structures in the different regions.

Figure 5:
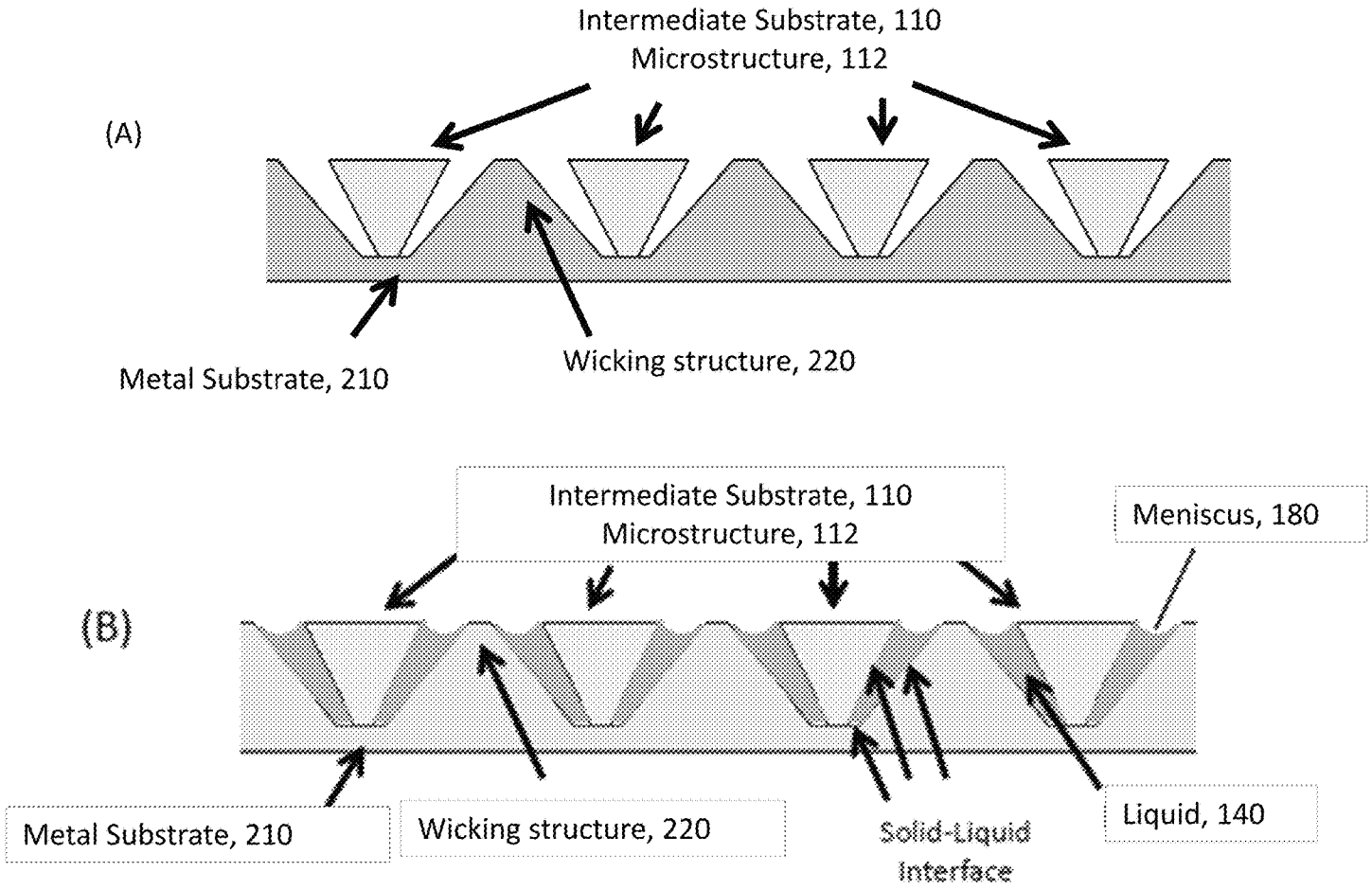
FIG. 5 is an illustrative embodiment of profile views of structural components of an embodiment where the structures are non-wetted (i.e. dry) and wetted by a liquid: (A) non-wetted structural components in the evaporator region, (B) wetted structural components in the evaporator region, (C) non-wetted structural components in the adiabatic region, (D) wetted structural components in the adiabatic region, (E) non-wetted structural components in the condenser region, (F) wetted structural components in the condenser region.
Figure 5:
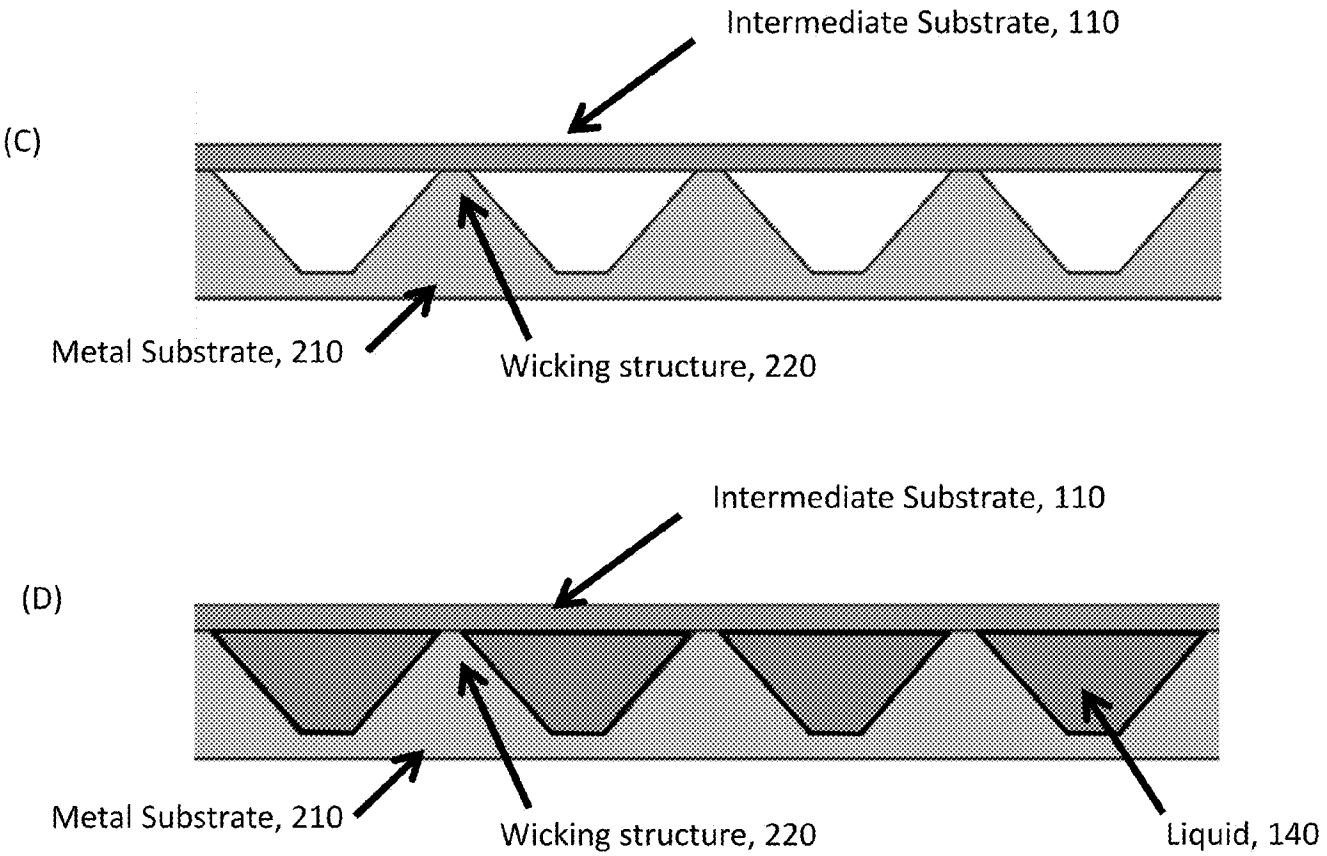
Figure 5:
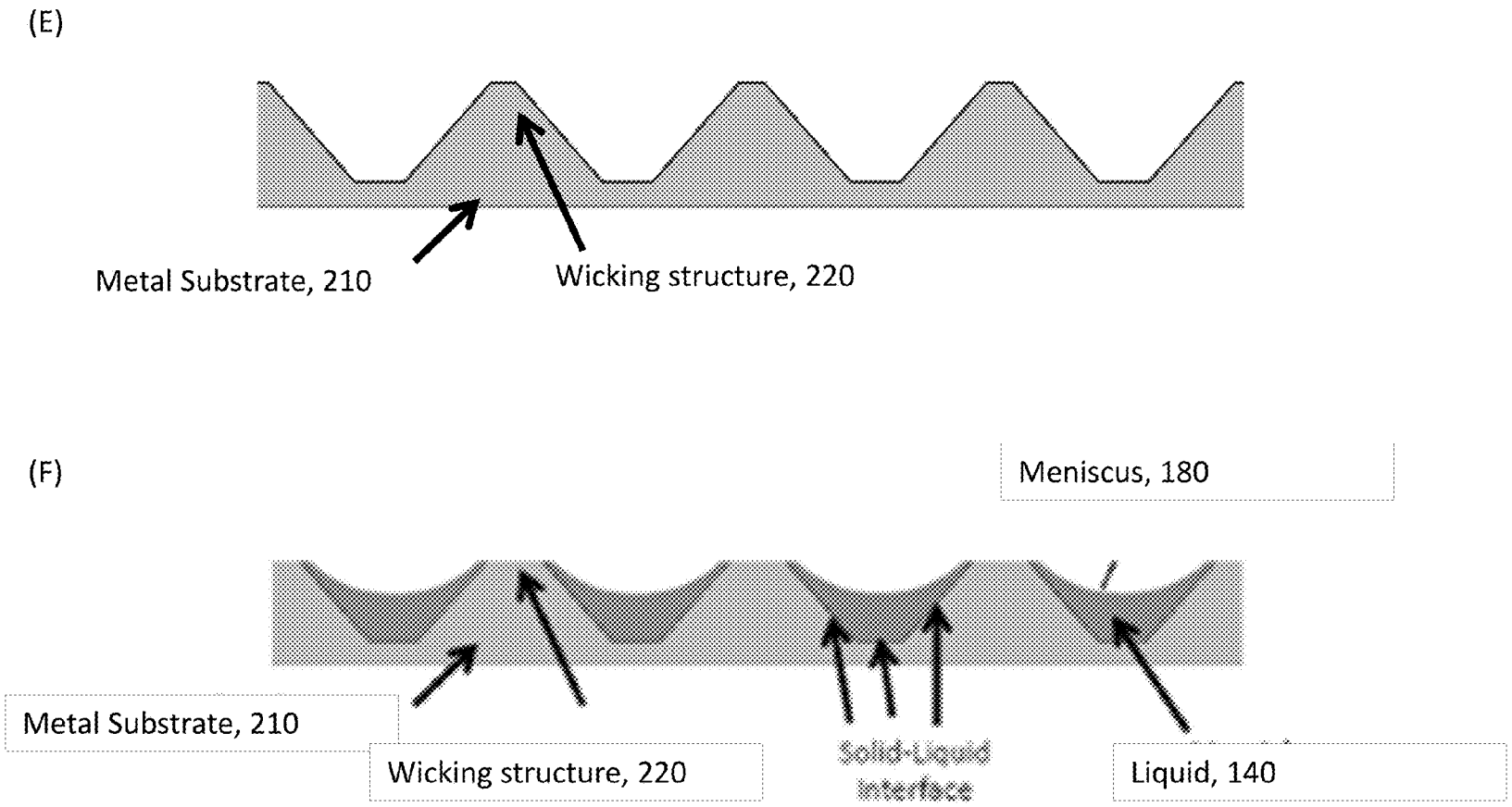

FIG. 5 shows profile views of structural components of an illustrative embodiment where the structures are non-wetted (i.e. dry) and are wetted by a liquid: (A) non-wetted structural components in the evaporator region, (B) wetted structural components in the evaporator region, (C) non-wetted structural components in the adiabatic region, (D) wetted structural components in the adiabatic region, (E) non-wetted structural components in the condenser region, (F) wetted structural components in the condenser region.

FIG. 5(A) shows a profile view of an illustrative embodiment where the intermediate substrate 110 comprises a plurality of microstructures 112 that are interleaved with the wicking structure 220 of the metal substrate 210.

FIG. 5(B) shows a profile view of an illustrative embodiment where the intermediate substrate 110 comprises a plurality of microstructures 112 that are interleaved with the wicking structure 220 of the metal substrate 210, and where the microstructures 112 and wicking structure 220 are wetted by a liquid 140.

By interleaving the microstructures 112 of the intermediate substrate 110 with the wicking structure 220 of the metal substrate 210, the interface area between the solid and liquid 140 could be substantially increased. This could increase the capillary forces that are applied to liquid 140, and could increase the amount of heat transferred from the metal solid to liquid 140.

FIG. 5(B) shows the meniscus 180 at the liquid-vapor interface. In some embodiments, gaps between the plurality of microstructures 112 contained in the intermediate substrate 110 and the wicking structure 220 could be formed so that they are substantially smaller than the depth of the wicking structure 220. In some embodiments the relatively small gaps between the plurality of microstructures 112 contained in the intermediate substrate 110 and the wicking structure 220 could provide effectively higher aspect ratio wicking channels, compared to some embodiments where the wicking structure 220 is formed by wet etching a single metal substrate 210 (as is common, and depicted in FIG. 4(C)).

In some embodiments, titanium could be used as a substrate material. The thermal conductivity of titanium is approximately $k_{Ti}$=20 W/(m K), and liquid water is approximately, $k_w$=0.6 W/(m K). Since the thermal conductivity of titanium is approximately 30 times higher than liquid water, the intermediate substrate 110 can provide additional thermal conduction pathways, which can decrease the thermal resistance between the outside surface of the thermal ground plane and liquid 140 located in the wicking structure 220. Furthermore, the microstructures 112 contained within the intermediate substrate 110 could increase the solid-liquid interface area, which could decrease the thermal resistance, and increase the critical heat flux that can occur, between titanium solid and liquid 140.

In some embodiments, the combination of the wicking structure 220 and the intermediate substrate 110 can effectively increase the aspect ratio of the channels in the wicking structure 220. Under very large pressure differences between the liquid and vapor phases, the meniscus 180 may be pushed down and not wet the top of the wicking structure 220. However, in some embodiments, the shape of the composite wicking structure 220 formed by interleaving the microstructures 112 of the intermediate substrate 110 with the wicking structure 220 may be chosen such that under large pressure differences across the meniscus 180, there is only partial dryout (or at least dryout could be substantially delayed) of the wicking structure 220 (so that the TGP continues to function), and the thermal ground plane does not undergo catastrophic dryout.

In previous two-phase heat transfer devices, instabilities can occur due to evaporation and/or boiling as the liquid phase is converted to the vapor phase. These instabilities can cause local dryout of the wicking structure 220 and can degrade the performance of the thermal ground plane. These instabilities can be substantially decreased in some of the current embodiments. For example, in some embodiments, the shape of the wicking structure 220 formed by interleaving the microstructures 112 of the intermediate substrate 110 with the wicking structure 220 may be chosen such that there can be substantial viscous resistance to liquid flow in the wicking structure 220. This viscous resistance can be advantageous as it can increase the stability of the evaporation and/or boiling process that may occur in the evaporator.

FIG. 5(C) shows a profile view an adiabatic region of an illustrative embodiment, where the intermediate substrate 110 is positioned in close proximity to the wicking structure 220. In some embodiments, the intermediate substrate 110 could be placed directly above the wicking structure 220. In some embodiments, the intermediate substrate 110 could be comprised of microstructures 112. In some embodiments, a solid intermediate substrate 110 could be used to isolate the vapor chamber 300 from the wicking structure 220. By isolating the vapor chamber 300 from the wicking structure 220, the solid-liquid interface area could be increased, and the liquid 140 could substantially fill the wicking structure 220, which could provide a higher mass flow rate of the liquid with less viscous pressure drop, compared to earlier wicking structures 220.

FIG. 5(D) shows a profile view an adiabatic region of an illustrative embodiment, where the intermediate substrate 110 is positioned in close proximity to the wicking, and where liquid 140 is wetted in the wicking structure 220. A solid intermediate substrate 110 could be used to isolate the vapor chamber 300 from the wicking structure 220. By isolating the vapor chamber 300 from the wicking structure 220, the solid-liquid interface area could be increased, and the liquid 140 could fill substantially the wicking structure 220, which could provide a higher mass flow rate for the liquid with less viscous pressure drop, compared to earlier wicking structures 220.

In some embodiments, where high-performance thermal energy transfer is desired, it may be important to decrease viscous losses of the liquid in the adiabatic region. In some embodiments, an intermediate substrate 110 could be used to isolate the vapor chamber 300 from the liquid 140 in the wicking structure 220. In some embodiments, where there is a large difference in pressure between the vapor and the liquid in the wicking structure 220, the vapor chamber 300 can be isolated from the liquid in the wicking structure 220 by a solid intermediate substrate 110, which could prevent the high difference in pressure from negatively affecting flow liquid in the wicking structure 220.

In earlier TGPs, wet-etched wicking channels could have low aspect ratios (i.e. low ratio between the channel height to the channel width). In some embodiments, if there is a large pressure difference between the vapor and liquid phases, the liquid phase may not completely fill the wicking channel, and the liquid 140 flow through the wicking structure 220 could be negatively impacted, and could lead the dryout of the wicking channel. In some embodiments of the current disclosure, an intermediate substrate 110 could be used to isolate the vapor chamber 300 from liquid 140 contained in the wicking structure 220, and could delay or even prevent dryout of the wicking structure 220.

FIG. 5(E) shows a profile view of a condenser region of an illustrative embodiment, where the wicking structure 220 is in direct communication with the vapor chamber 300. When the wicking structure 220 is in direct communication with the vapor chamber 300, vapor could condense more readily onto the wicking structure 220. Furthermore, in regions, such as the condenser, there might not be significant differences in pressure between the liquid and vapor phases, and an intermediate substrate 110 may not provide significant advantages. However, for a case where the condenser region is large, significant differences in pressure between the liquid phase and the vapor phase could exist and accordingly, the condenser region could conceivably benefit from at least one intermediate substrate 110 with microstructures 112, whose effect is to increase the aspect ratio of the wicking structure 220, thereby shortening the meniscus 180 length and thus increasing the amount of pressure that the meniscus 180 can support, as described above for the evaporation region.

FIG. 5(F) shows a profile view of a condenser region of an illustrative embodiment, where the wicking structure 220 is in direct communication with the vapor chamber 300, where the wicking structure 220 is wetted by a liquid 140. In some embodiments, there may not be a significant difference in pressure between the vapor chamber 300 and the liquid 140 in the wicking structure 220, and an intermediate substrate 110 may not provide significant advantages. However, for a case where the condenser region is large, significant pressure difference between the liquid phase and the vapor phase could exist and accordingly, the condenser region could conceivably benefit from microstructures 112 whose effect is to increase the aspect ratio of the wicking structure 220 and increase the amount of pressure that the meniscus 180 can support, as described above for the evaporation region.

Figure 6:
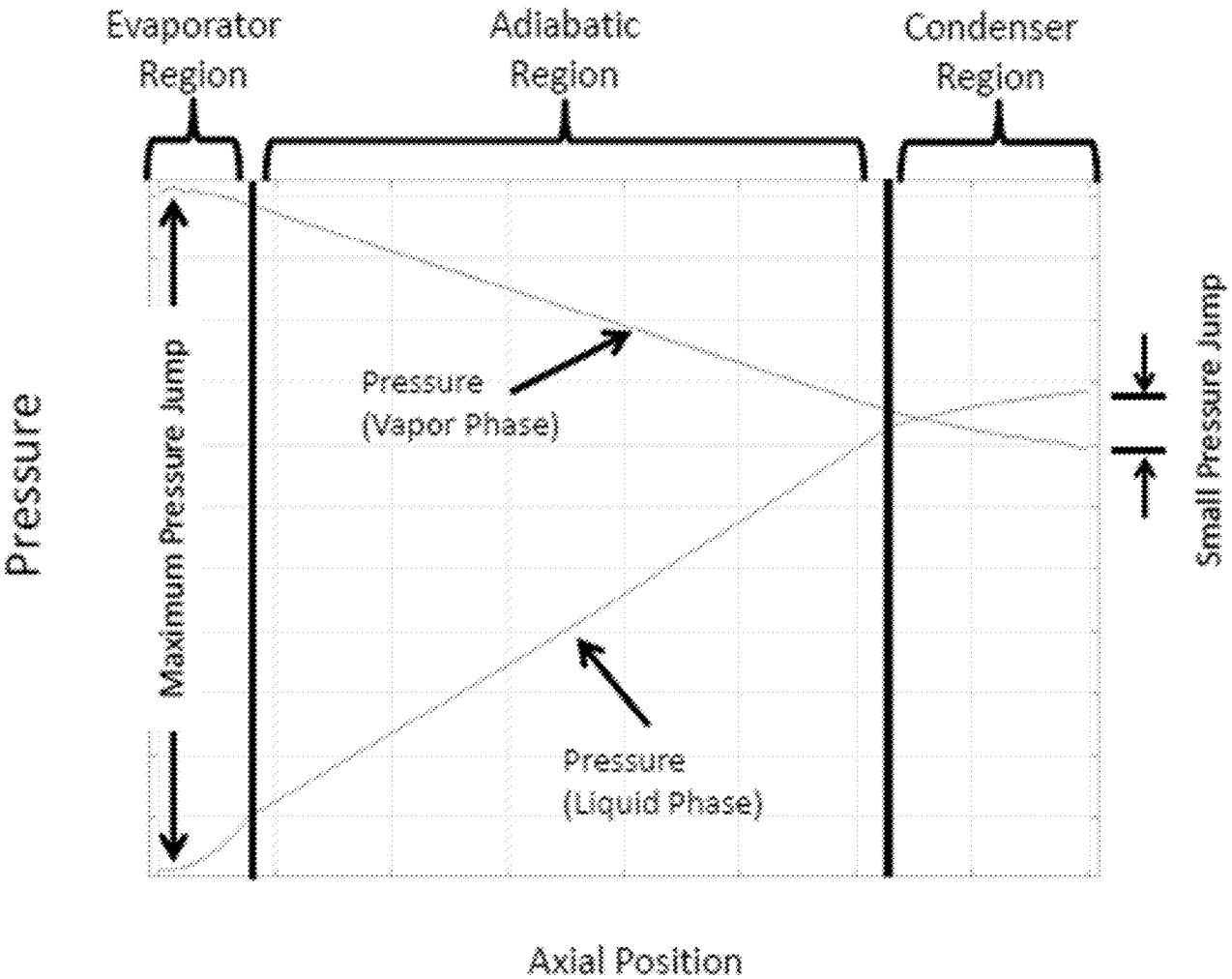
FIG. 6 shows pressure profiles as a function of axial location for an illustrative embodiment of a thermal ground plane. The curves show the pressure of the vapor phase in the vapor chamber and the liquid phase in the wicking structure. In this case, the maximum pressure difference between the liquid and vapor phases occurs in the evaporator region. The minimum pressure difference between the vapor and liquid phases occurs in the condenser region.

FIG. 6 shows pressure profiles as a function of axial location for an illustrative embodiment of a thermal ground plane. The curves show the pressure of the vapor phase in the vapor chamber 300 and the liquid phase in the wicking structure 220. In an illustrative embodiment, the maximum pressure difference between the liquid and vapor phases could occur in the evaporator region. In an illustrative embodiment, the minimum pressure difference between the vapor and liquid phases could occur in the condenser region.

Wicking structures 220 may be comprised of channels, pillars, or other structures. If these structures are formed by wet etching or other fabrication processes, they may be comprised of features with low aspect ratios. Earlier wicking structures 220 could be comprised of low-aspect ratio channels or pillars, and did not include an intermediate structure. In these earlier low-aspect ratio wicking structures 220, a large pressure difference between the liquid phase and the vapor phase could cause the meniscus 180 between the two phases to extend towards the bottom of the channel, thereby decreasing the amount of liquid 140 occupying the channel and significantly decreasing the mass flow of the liquid. This in turn could cause poor heat transfer performance and possible dryout of the wicking structure 220.

As shown in FIG. 6, the highest vapor pressure typically occurs in the evaporator region, and the vapor pressure, due to viscous losses, increases with the amount of heat transferred by the TGP. Further, it may be desirable to make the overall thickness of the thermal ground plane as thin as practically possible, which might be accomplished by making the vapor chamber 300 relatively thin. A relatively thin vapor chamber 300 could cause substantial viscous losses of the vapor flowing in the vapor chamber 300 from the evaporator through the adiabatic region to the condenser. High viscous losses of vapor flowing in the vapor chamber 300 can also contribute to a large difference in pressure between the liquid and vapor phases in the evaporator. An intermediate substrate 110 structure, which increases the aspect ratio of the wicking structure 220, as described above, has the effect of decreasing the meniscus 180 length of the liquid/vapor interface, making the radius of curvature smaller, in this part of the wicking structure 220, thereby making the meniscus 180 more resistant to high meniscus 180 pressure (FIG. 5(B)) and making the TGP capable of supporting much higher pressures than previous implementations. Accordingly, at least one region of the at least one intermediate substrate may have a plurality of microstructures that are interleaved with at least one region of the wicking structure to form high aspect ratio wicking structures, in at least one region of the thermal ground plane. Furthermore, at least one intermediate substrate may be in close proximity to the wicking structure, to isolate the liquid phase and vapor phase, in at least one region of the thermal ground plane.

Supporting higher pressure differences between the liquid phase and the vapor phase allows for more heat to be transferred without drying out the wicking structure 220 as well as making the TGP more resistant to viscous losses resulting from thinner designs. Thus the addition of the intermediate substrate 110 may achieve both higher heat transfer and thinner ground planes, simultaneously.

In some embodiments, the thermal ground plane could be filled with a specified mass of saturated liquid/vapor mixture such that difference in pressure between the vapor and liquid phases in the condenser is well controlled. In some embodiments the mass of the liquid/vapor mixture could be chosen so that part of the condenser region could contain liquid at a higher pressure than adjacent vapor.

Figure 7:
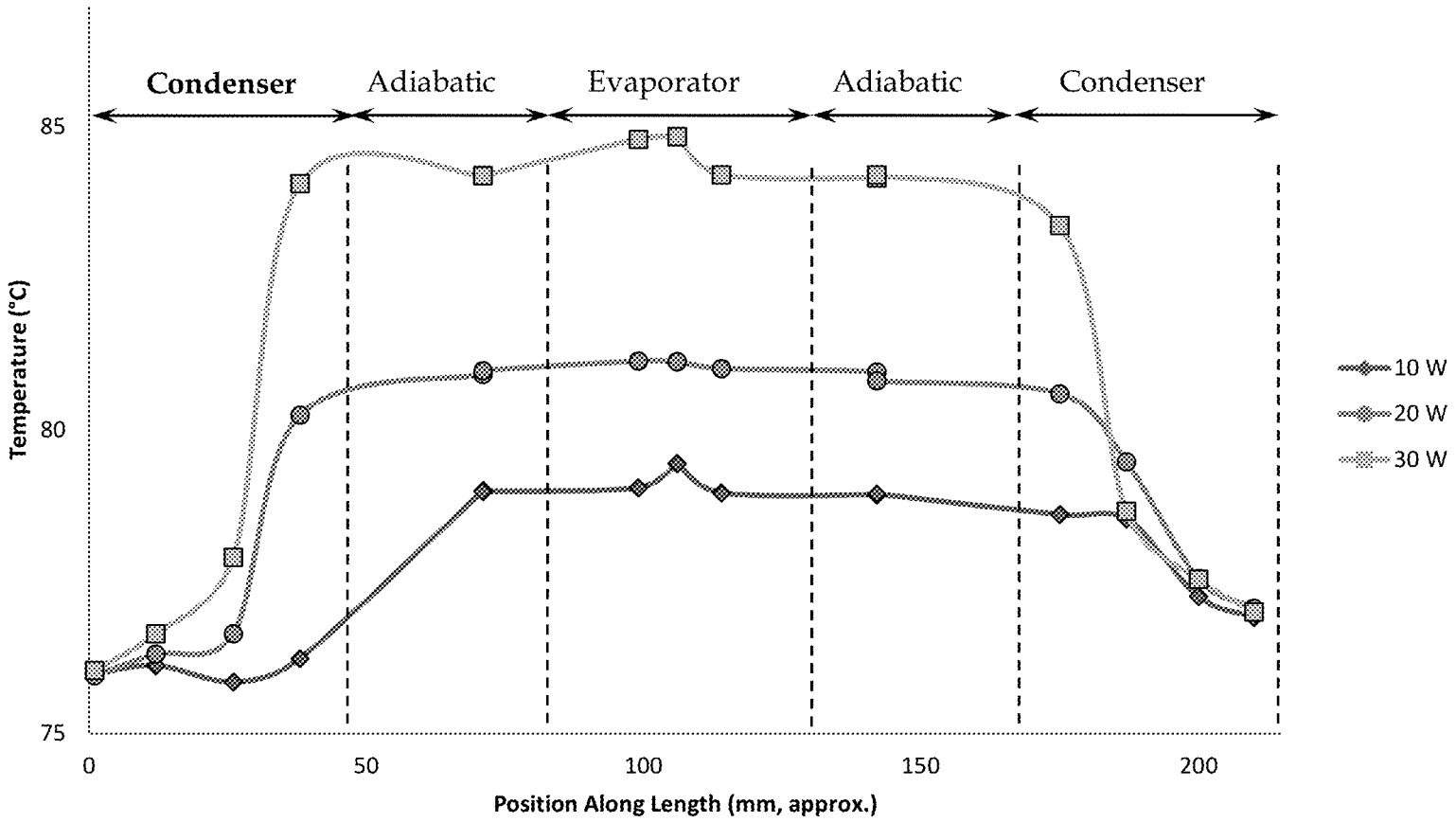
FIG. 7 shows temperature profiles as a function of axial location for an illustrative embodiment of a thermal ground plane, under heat loadings of Q=10, 20, and 30 W. In this embodiment, the evaporator is in the center, and there are adiabatic and condenser regions on each side.

FIG. 7 shows temperature profiles as a function of axial location for an illustrative embodiment of a thermal ground plane, under heat transfer rates of Q=10, 20, and 30 W. In this illustrative embodiment, the evaporator is in the center, and there are is an adiabatic and condenser region on each side. The results demonstrate the utility of an embodiment of a titanium thermal ground plane with an intermediate substrate 110.

Figure 8:
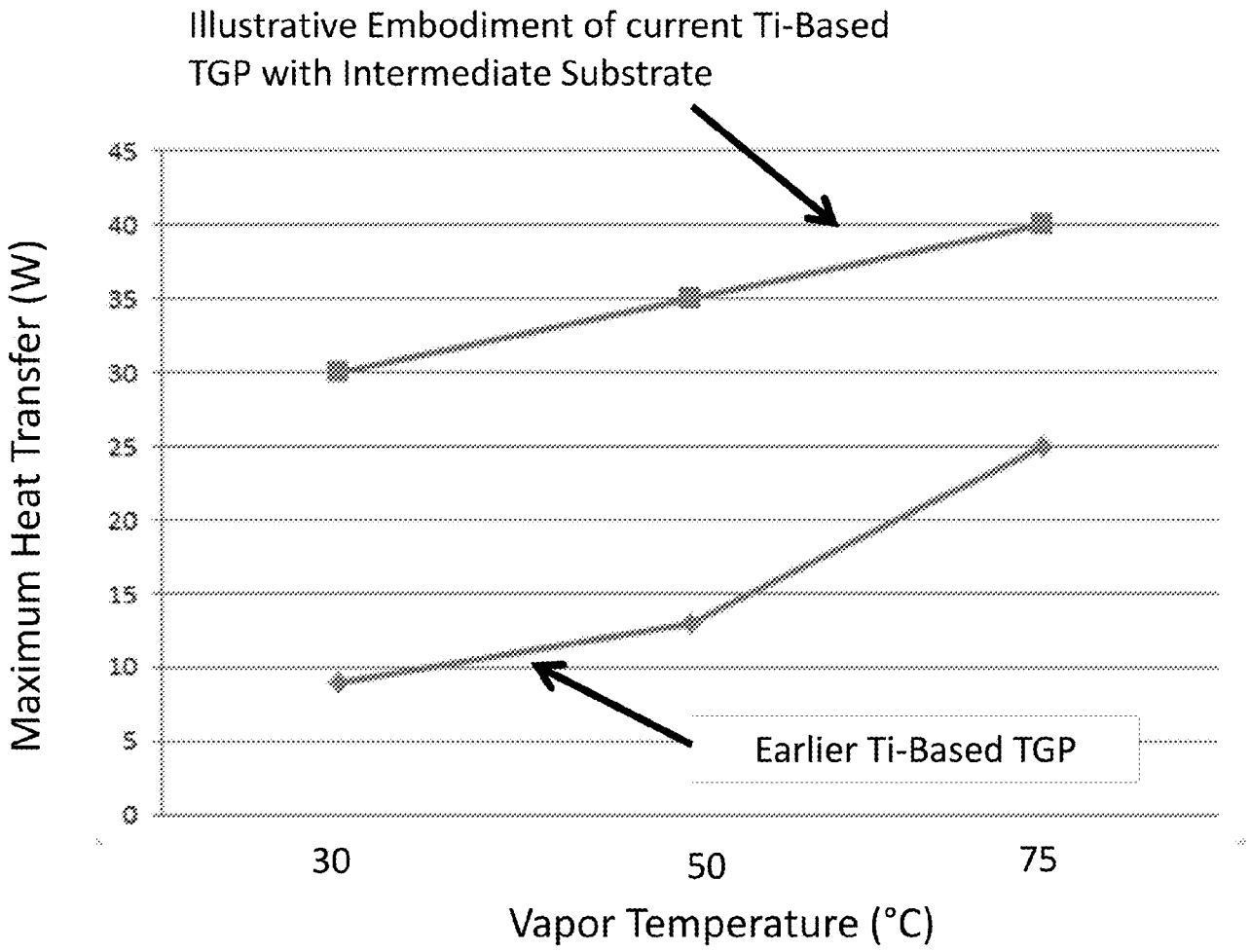
FIG. 8 compares maximum heat transfer for titanium-based thermal ground planes for different vapor temperatures. The comparison is between an earlier titanium thermal ground plane, and an illustrative embodiment of the current thermal ground plane using an intermediate substrate.

FIG. 8 compares maximum heat transfer for titanium-based thermal ground planes for different vapor temperatures. The comparison is between an earlier titanium thermal ground plane, and an illustrative embodiment of the current thermal ground plane using an intermediate substrate 110.

An earlier titanium thermal ground plane with similar dimensions to embodiments tested for FIG. 7 might only be capable of transferring about 10 W of thermal energy before the wicking structure 220 exhibits dryout at an operating vapor temperature of 30° C., compared to 30 W for an illustrative embodiment of the current thermal ground plane using an intermediate substrate 110. Similarly, as vapor temperature is increased, the maximum thermal energy transferred for an illustrative embodiment of the current thermal ground plane is increased to 35 W and 40 W, for operating vapor temperatures of 50° C. and 70° C., respectively. In all cases, the maximum thermal energy transferred for an illustrative embodiment of the current thermal ground plane is 15-20 W more than what is observed from an earlier thermal ground plane.

Figure 9:
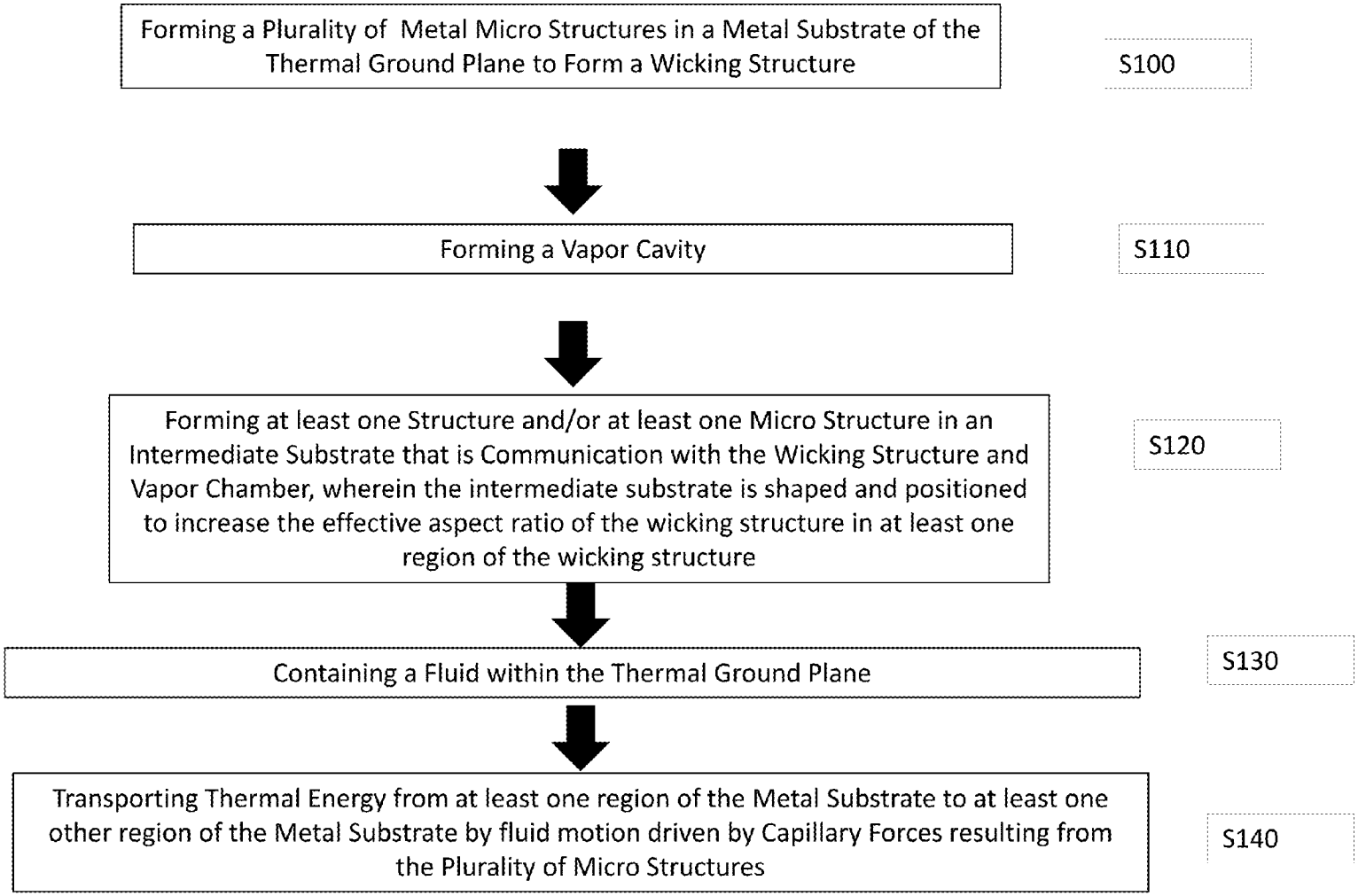
FIG. 9 is an illustrative embodiment of a flow chart of the formation of one or more embodiments of the current Ti-based TGP (metal-based Thermal Ground Plane) in accordance with one or more embodiments.

FIG. 9 illustrates a flow chart of the formation of one or more embodiments of the current Ti-based TGP in accordance with one or more embodiments of the present invention. In some embodiments, thermal energy can be transported by (1) forming a plurality of metal micro structures in a metal substrate of the thermal ground plane to form a wicking structure in step S100. In step S110, a vapor cavity may be formed. In step S120, at least one structure and/or at least one microstructure in an intermediate substrate that is communication with the wicking structure and vapor chamber, wherein the intermediate substrate is shaped and positioned to increase the effective aspect ratio of the wicking structure in at least one region of the wicking structure. In step S130, a fluid may be contained within the thermal ground plane. In step S140, thermal energy may be transported from at least one region of the metal substrate to at least one other region of the metal substrate by fluid motion driven by capillary forces, resulting from the plurality of microstructures.

Figure 10:
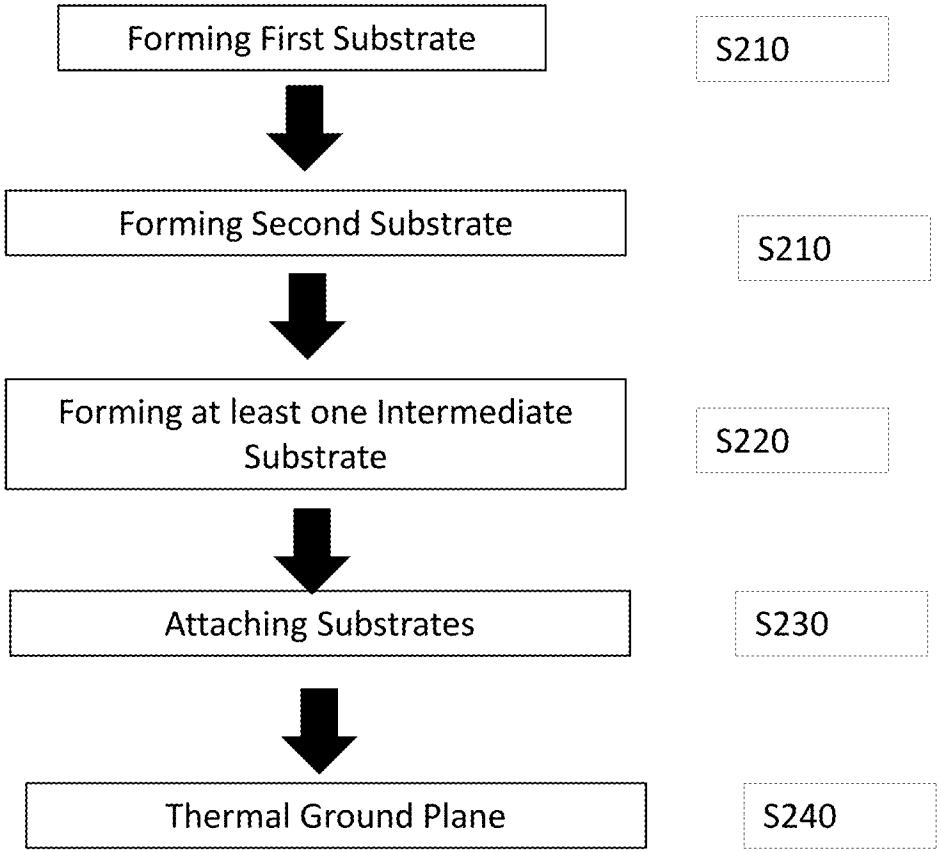
FIG. 10 is an illustrative embodiment of a flow chart of the formation of one or more embodiments of the current Ti-based TGP.

FIG. 10 illustrates a flow chart of the formation of one or more embodiments of the current Ti-based TGP in accordance with one or more embodiments of the present invention. In some embodiments a metal-based thermal ground plane can be formed by the following process. In step S200, the first substrate is formed. In step S210, a second substrate is formed. In step S220, at least one intermediate substrate is formed. In step S230, the substrates are attached. In step S240, the thermal ground plane is formed.

Figure 11:
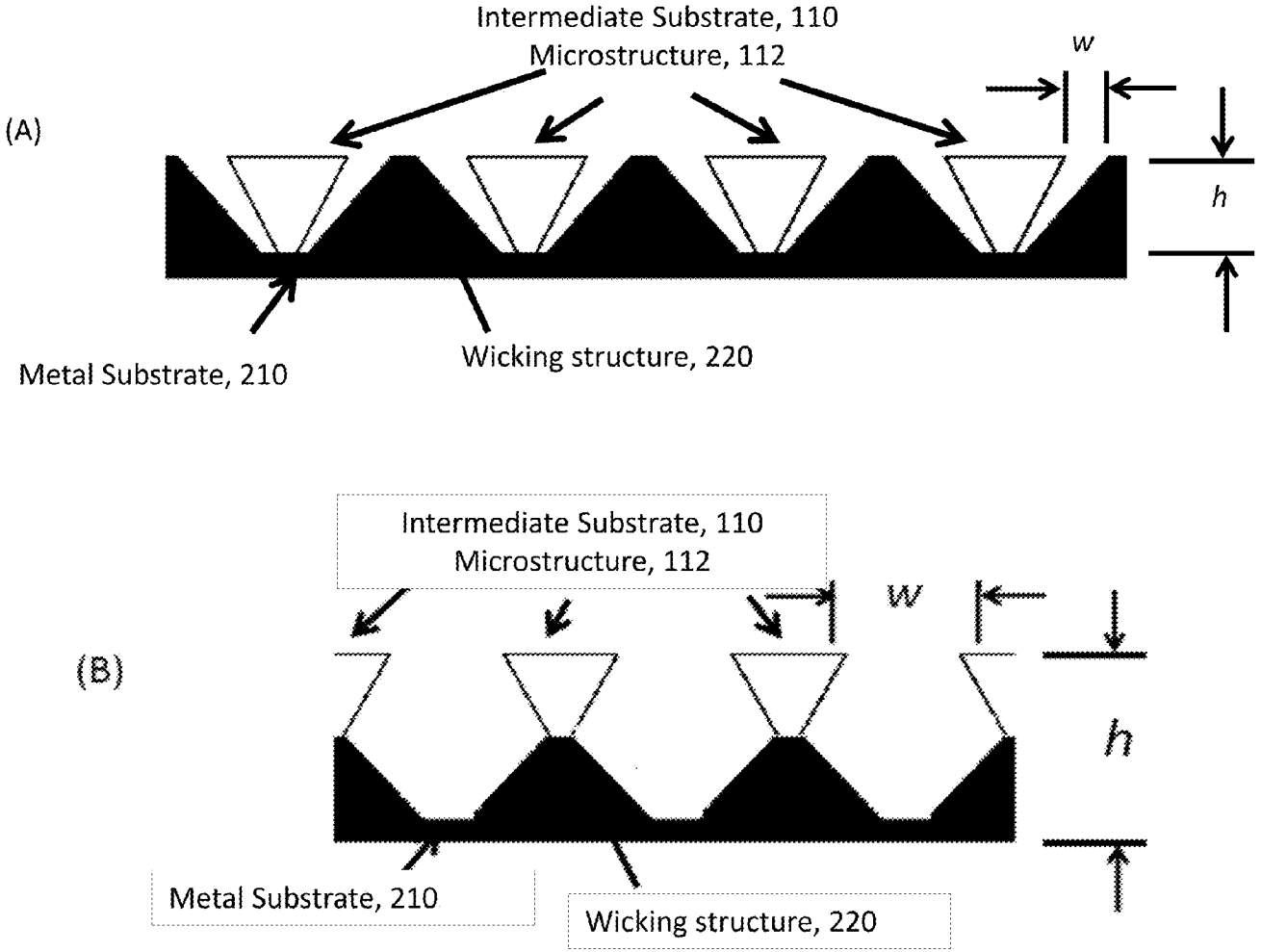
FIG. 11 shows illustrative embodiments of a wicking structure in communication with an intermediate substrate. The effective aspect ratio is defined as the ratio of the effective channel height, h, to the effective channel width, w: (A) shows an illustrative embodiment where the microstructures in the intermediate substrate are interleaved with the wicking structure, (B) shows an alternative embodiment where the microstructures in the intermediate substrate are positioned above the wicking structure.

FIG. 11 shows illustrative embodiments of a wicking structure 220 in communication with an intermediate substrate 110. The effective aspect ratio is defined as the ratio of the effective channel height, h, to the effective channel width w: (A) shows an illustrative embodiment where the microstructures 112 of the intermediate substrate 110 are interleaved with the wicking structure 220, (B) shows an alternative embodiment where the microstructures 112 of the intermediate substrate 110 are positioned above the wicking structure 220.

The illustrative embodiments shown in FIG. 11 could provide effective aspect ratios that are higher than what might be obtained by the wicking structure 220 without including an intermediate substrate 110. For example, if the wicking structure 220 is formed by a wet etching or other isotropic etching process, the aspect ratio h/w may be less than unity, or substantially less than unity. Using an intermediate substrate 110, higher effective aspect ratios of the fluid channel between the wicking structure 220 and the intermediate substrate 110, may be achieved. For example, in some embodiments, h/w>1 wherein h is the effective height (or depth) of the fluid channel and w is the width.

FIG. 11(B) shows an alternative embodiment, which could have advantages when relatively low viscous losses are desirable.

Figure 12:
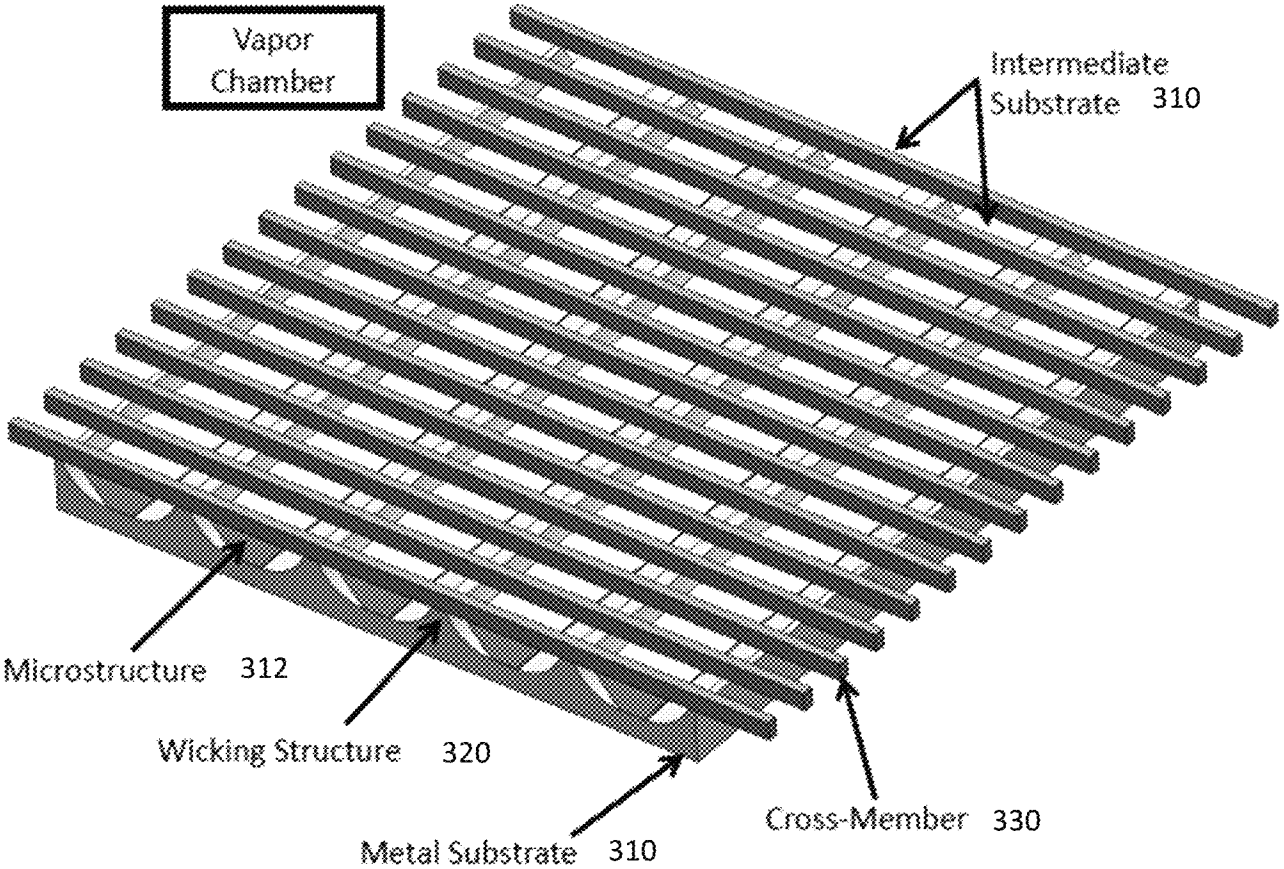
FIG. 12 is a perspective view an intermediate substrate with a plurality of supporting cross members.

FIG. 12 shows an illustrative embodiment where the intermediate substrate 310 comprises a plurality of microstructures 312 that are interleaved with the wicking structure 320. The interleaved microstructures 312 are mechanically connected to cross-members 330. In some embodiments, the interleaving microstructures 312 and the cross-members 330 are formed from a single substrate. The cross-members 330 can be formed from a metal or other material. In some embodiments, metal cross-members 330 could be comprised of titanium, copper, aluminum, stainless steel, or other metal. In some embodiments, the interleaving microstructures 312 and cross-members 330 can be formed by chemical etching metal foil, such as a titanium metal foil, copper metal foil, stainless steel metal foil, aluminum metal foil, and the like.

In some embodiments, cross-members 330 can provide mechanical support to the interleaved microstructures 312. In some embodiments, cross-members 330 can transfer thermal energy through thermal conduction between interleaving microstructures 312 or throughout the thermal ground plane. In some embodiments, the cross-members 330 can provide a wetting surface so that liquid can be transported through capillary forces along cross-members. This can provide fluid communication between interleaving microstructures.

In some embodiments, cross-members 330 can provide surface area to facilitate condensation of vapor.

Figure 13:
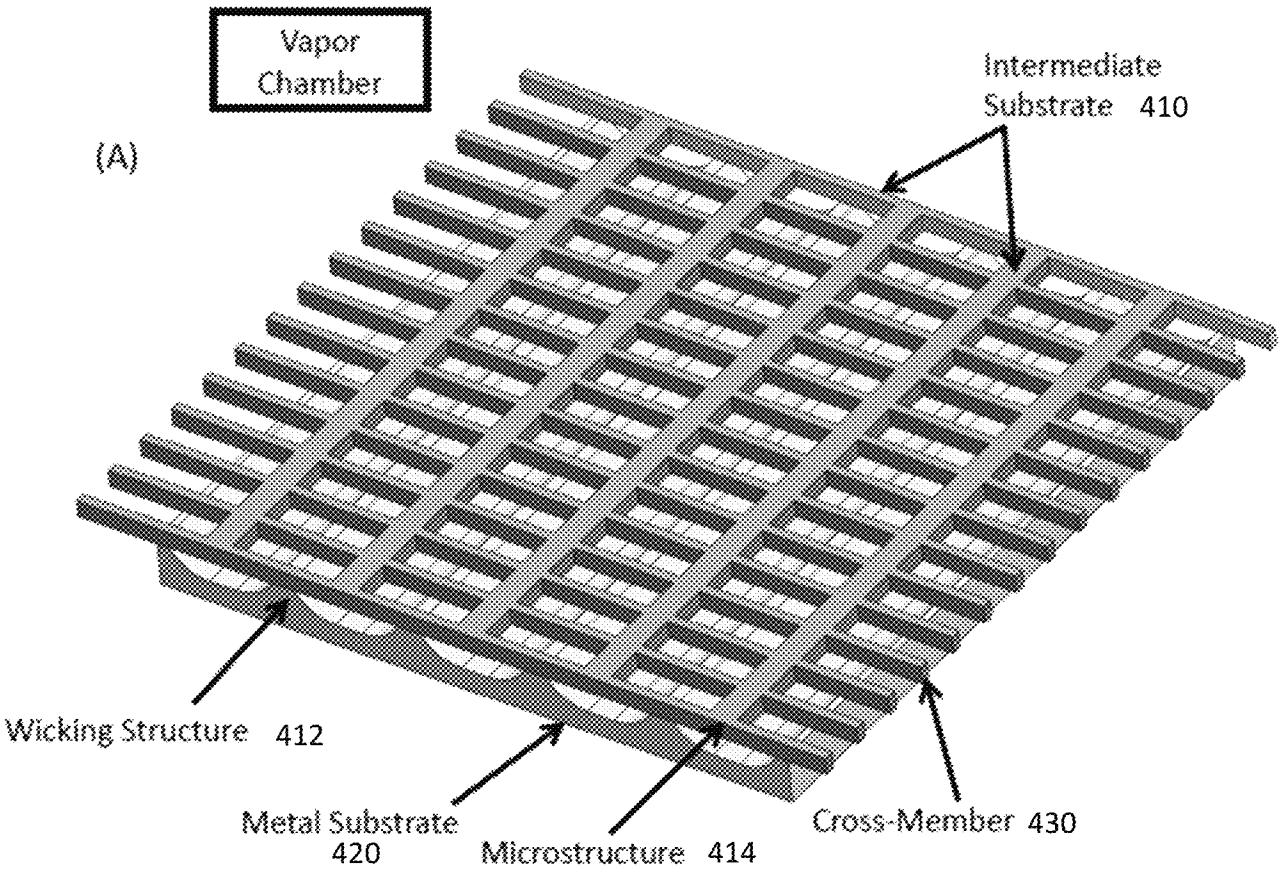
FIG. 13 is a perspective view of an intermediate substrate with supporting cross members, wherein (A) the microstructures are in communication with cross-members and (B) wherein the microstructures and cross-members are positioned directly above the wicking structure.
Figure 13:
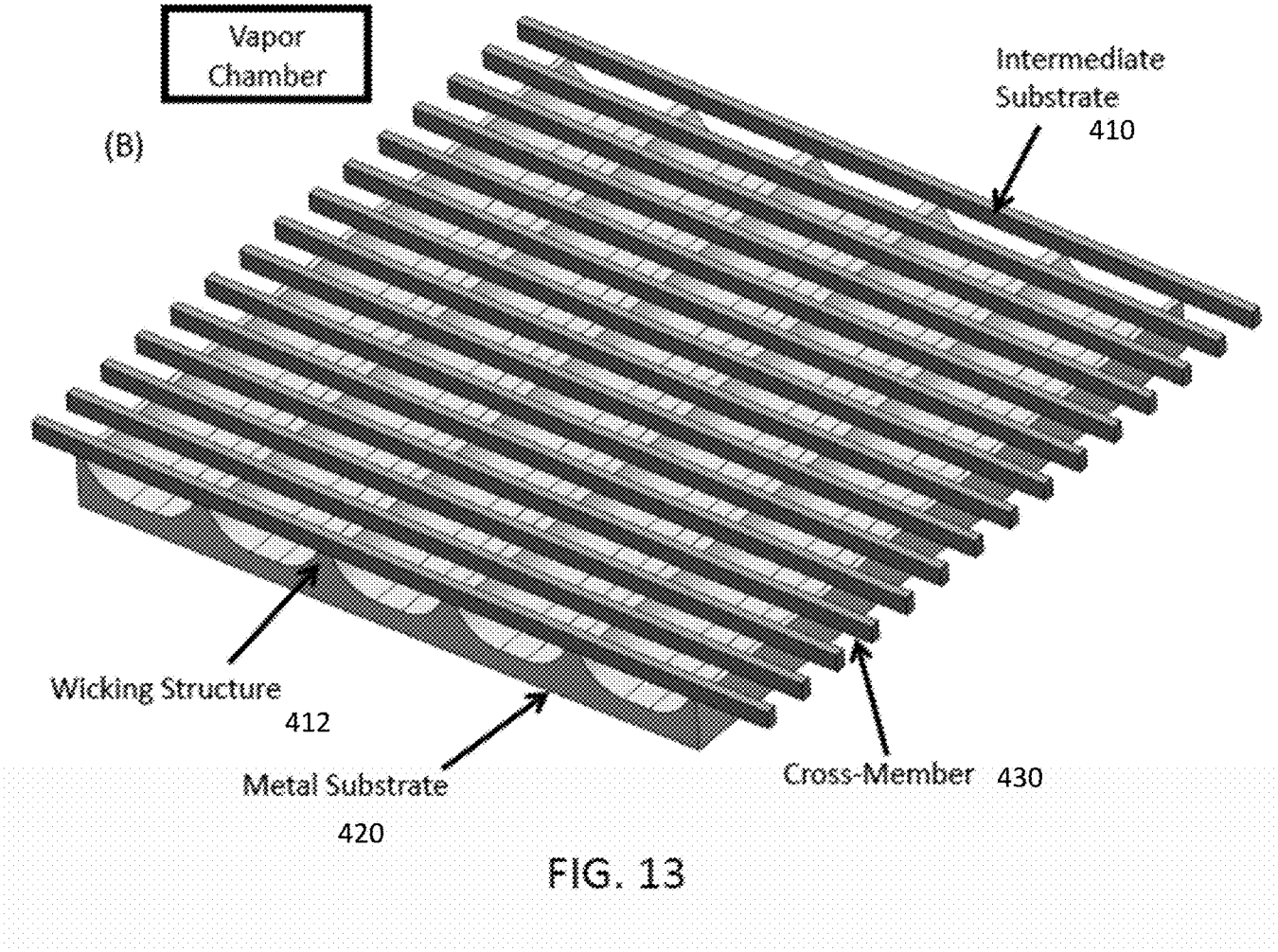

FIG. 13 shows an illustrative embodiment where the intermediate substrate 410 comprises a plurality of cross-members 430. Wicking structure 412 is formed from metal substrate 420. FIG. 13(A) shows an illustrative embodiment wherein microstructures 414 are in communication with cross-members 430. In an illustrative embodiment, microstructures 414 and cross-members 430 can be positioned directly above the wicking structure 412. FIG. 13(B) shows an illustrative embodiment where cross-members 430 are positioned directly above the wicking structure 412.

In some embodiments, an intermediate substrate 410 could be configured with cross-members 430 and could be positioned in the condenser region of the thermal ground plane. In some embodiments, an intermediate substrate 410 could be configured with cross-members 430 and could be positioned in the adiabatic region of the thermal ground plane. In some embodiments, an intermediate substrate 410 could be configured with cross-members 430 and could be positioned in the evaporator region of the thermal ground plane.

Figure 14:
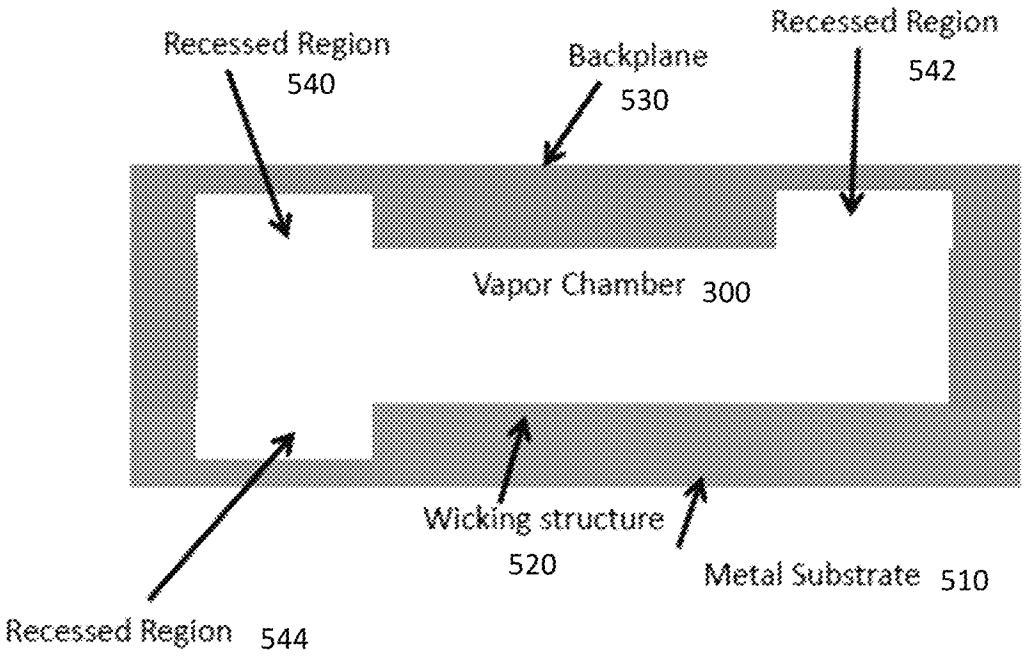
FIG. 14 is a profile view of an illustration of a vapor chamber with one or more recessed regions.

FIG. 14 shows a profile view an illustrative embodiment where a vapor chamber can be comprised of one or more recessed regions 540, 542 and 544. Viscous flow of vapor in the vapor chamber can be described by Poiseuille flow, where for a given pressure drop, density and viscosity, the mass flow rate of vapor scales with the cube of the vapor chamber height ~$h^3$. For very thin vapor chambers, viscous losses can be substantial and limit the overall performance of the thermal ground plane. In some embodiments, vapor chambers 300 can be configured with one or more recessed regions 540, thereby increasing the effective height of the vapor chamber, h, in chosen regions of the thermal ground plane. Since the mass flow rate of vapor can vary with $h^3$, increasing the height of the vapor chamber in chosen regions can substantially increase the mass flow rate of vapor through the chamber, for a given pressure drop.

In some embodiments, the one or more recessed regions 544 can be formed in the metal substrate and located adjacent to the wicking structure. In some embodiments, the one or more recessed regions 540 and 542 can be formed in the backplane 530. In some embodiments, the one or more recessed regions can be formed in a combination of the metal substrate and backplane. In some embodiments, recessed regions can be configured to be in communication with other recessed regions, in order to minimize viscous losses in the vapor chamber. In some embodiments, recessed region 540 could be aligned with recessed region 544, so that the overall depth of the vapor chamber in that region is increased by the combination of recessed region 540 and recessed region 544. Vapor mass flow rate can vary with the vapor chamber height cubed, ~$h^3$. Therefore, the combination of recessed region 540 and recessed region 544 can have a non-linear effect on reducing viscous losses, and thereby increase overall mass flow rate.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. Accordingly, the exemplary implementations set forth above, are intended to be illustrative, not limiting.

What is claimed is:

1. A thermal ground plane, comprising:

a metal substrate comprising a plurality of microstructures formed in the metal substrate, forming a wicking structure having the plurality of microstructures;

a vapor cavity, in communication with the wicking structure and the plurality of microstructures;

at least one intermediate substrate with a plurality of protrusions, wherein the plurality of protrusions are directly coupled to each other by at least one cross-member disposed internal to the vapor cavity on the opposite side of the at least one intermediate substrate relative to the metal substrate, and wherein the plurality of protrusions is shaped to increase the effective aspect ratio of the wicking structure by fitting into the plurality of microstructures of the wicking structure in at least one region of the wicking structure; and a fluid contained within the thermal ground plane for transporting thermal energy from at least one region of the thermal ground plane to another region of the thermal ground plane, wherein the fluid is driven by capillary forces in at least two orthogonal directions, along the microstructures and along the at least one cross member.

2. The thermal ground plane of claim 1, further comprising a metal backplane, wherein the vapor cavity is enclosed by the metal substrate and the metal backplane.

3. The thermal ground plane of claim 2, wherein the metal substrate is bonded to the metal backplane to form a hermetically-sealed vapor cavity.

4. The thermal ground plane of claim 1, wherein the plurality of microstructures comprises a plurality of channels, and wherein the plurality of protrusions fits conformally into the plurality of channels of the wicking structure.

5. The thermal ground plane of claim 1, wherein the plurality of microstructures has a characteristic dimension of 1-1000 micrometers.

6. The thermal ground plane of claim 1, wherein the plurality of microstructures on the intermediate substrate are interleaved with at least one region of the wicking structure to form high effective aspect ratio wicking structures, in at least one region of the thermal ground plane.

7. The thermal ground plane of claim 1, wherein the at least one intermediate substrate is in close proximity to the wicking structure, isolating a liquid phase and a vapor phase, in at least one region of the thermal ground plane.

8. The thermal ground plane of claim 5, wherein the at least one intermediate substrate is comprised of at least one opening, wherein the opening is substantially larger than said microstructures, so the wicking structure and vapor chamber are in direct communication, in at least one region of the thermal ground plane.

9. The thermal ground plane of claim 2, wherein the backplane further comprises standoffs that in combination with the intermediate substrate and the metal substrate, structurally support the thermal ground plane.

10. The thermal ground plane of claim 2, wherein the substrate, the at least one intermediate substrate and the backplane comprise titanium.

11. The thermal ground plane of claim 10, wherein the titanium substrate is connected to the titanium backplane by a laser weld, to form a hermetically-sealed vapor cavity.

12. The thermal ground plane of claim 1, wherein the plurality of protrusions fit conformally into the wicking structure, to form narrow fluid passages through which the fluid is driven by capillary forces.

13. The thermal ground plane of claim 12, wherein the protrusions are shaped to fit into features in the wicking structure.

14. The thermal ground plane of claim 6, wherein the effective aspect ratio h/w of the fluid channel between the wicking channel and the intermediate substrate is greater than 1, wherein h is the effective height and w is the width of the fluid channel.

15. The thermal ground plane of claim 1, wherein the microstructures comprise at least one of channels, pillars, grooves and trenches.

16. The thermal ground plane of claim 1, wherein a surface of at least one region of the thermal ground plane is comprised of nanostructured titania (NST).

17. The thermal ground plane of claim 1, wherein one or more of the microstructures have a height of between about 1-1000 micrometers, a width of between about 1-1000 micrometers, and a spacing of between about 1-1000 micrometers.

18. The thermal ground plane of claim 1, wherein the thermal ground plane has an evaporator region, an adiabatic region, and a condenser region, and wherein the intermediate substrate has a different topography in the evaporator region relative to an adiabatic region.

* * * * *